US009035857B2

(12) United States Patent
Kobayashi

(10) Patent No.: US 9,035,857 B2
(45) Date of Patent: May 19, 2015

(54) IMAGE DISPLAY DEVICE, CONTROL METHOD FOR AN IMAGE DISPLAY DEVICE, AND ADJUSTMENT SYSTEM FOR AN IMAGE DISPLAY DEVICE

(75) Inventor: Yoshinao Kobayashi, Kanagawa (JP)

(73) Assignee: LG Display Co., Ltd., Seoul (KR)

( * ) Notice: Subject to any disclaimer, the term of this patent is extended or adjusted under 35 U.S.C. 154(b) by 991 days.

(21) Appl. No.: 12/665,272

(22) PCT Filed: Jul. 30, 2008

(86) PCT No.: PCT/JP2008/063666

§ 371 (c)(1),
(2), (4) Date: Dec. 17, 2009

(87) PCT Pub. No.: WO2009/017156

PCT Pub. Date: Feb. 5, 2009

(65) Prior Publication Data

US 2010/0171733 A1 Jul. 8, 2010

(30) Foreign Application Priority Data

Jul. 30, 2007 (JP) ..... 2007-197296

(51) Int. Cl.
*G09G 3/32* (2006.01)

(52) U.S. Cl.
CPC ..... *G09G 3/3208* (2013.01); *G09G 2320/041* (2013.01); *G09G 2320/043* (2013.01); *G09G 2330/02* (2013.01); *G09G 2360/145* (2013.01); *G09G 2360/16* (2013.01)

(58) Field of Classification Search
CPC ..... G09G 3/3233
USPC ..... 345/76, 77, 690, 82; 382/168
See application file for complete search history.

(56) References Cited

U.S. PATENT DOCUMENTS 7,075,242 B2 * 7/2006 Miller et al. ..... 315/169.3
7,164,400 B2 * 1/2007 Mizukoshi et al. ..... 345/76

(Continued)

FOREIGN PATENT DOCUMENTS

JP 10-31450 A 2/1998
JP 2001-343932 12/2001

(Continued)

*Primary Examiner* — Quan-Zhen Wang
*Assistant Examiner* — Calvin C Ma
(74) *Attorney, Agent, or Firm* — Birch, Stewart, Kolasch & Birch, LLP

(57) ABSTRACT

It is aimed to provide a technology capable of stabilizing light-emitting luminance of an image display device. In order to achieve the above-mentioned object, an image display device includes a pixel circuit including a light-emitting element, a recognizing portion which recognizes a predicted value of a parameter on driving of the pixel circuit based on image data, and an obtaining portion which obtains an actually-measured value of the parameter while causing the light-emitting element to emit light in accordance with the image data. This image display device further includes a comparing portion which compares the predicted value and the actually-measured value with each other, and a control portion which controls a power supply voltage applied to the pixel circuit in accordance with a comparison result of the comparing portion. The control portion increases/decreases, in response to a fact that the actually-measured value falls outside a first reference range with the predicted value being as a reference, the power supply voltage so that the actually-measured value is included in a second reference range which is within the first reference range and is narrower than the first reference range, and stops the increase/decrease of the power supply voltage in a case where a relationship in which the actually-measured value is included in the second reference range is satisfied. Note that the control portion may be provided outside the image display device.

12 Claims, 14 Drawing Sheets

(56) References Cited

U.S. PATENT DOCUMENTS

| | | | | |
|---|---|---|---|---|
| 7,595,795 | B2 * | 9/2009 | Shin et al. | 345/207 |
| 7,808,459 | B2 * | 10/2010 | Lee et al. | 345/77 |
| 2003/0063081 | A1 | 4/2003 | Kimura et al. | |
| 2004/0004610 | A1 | 1/2004 | Iwami et al. | |
| 2004/0032382 | A1 | 2/2004 | Cok et al. | |
| 2004/0201554 | A1 | 10/2004 | Satoh | |
| 2006/0077200 | A1 | 4/2006 | Tamayama | |
| 2006/0152454 | A1 * | 7/2006 | Cok et al. | 345/82 |
| 2006/0279970 | A1 * | 12/2006 | Kernahan | 363/65 |
| 2007/0001940 | A1 * | 1/2007 | Jo | 345/77 |
| 2007/0080905 | A1 * | 4/2007 | Takahara | 345/76 |
| 2007/0164937 | A1 | 7/2007 | Jung et al. | |
| 2008/0018640 | A1 | 1/2008 | Tada et al. | |
| 2009/0066631 | A1 * | 3/2009 | Lianza | 345/102 |

FOREIGN PATENT DOCUMENTS

| | | | | |
|---|---|---|---|---|
| JP | 2003-029710 | | 1/2003 | |
| JP | 2003-150113 | | 5/2003 | |
| JP | 2003-330419 | | 11/2003 | |
| JP | 2004-29553 | A | 1/2004 | |
| JP | 2004-038209 | | 2/2004 | |
| JP | 2004-38209 | A | 2/2004 | |
| JP | 2004 102077 | | 4/2004 | |
| JP | 2004-317531 | A | 11/2004 | |
| JP | 2005-055909 | | 3/2005 | |
| JP | 2005-122076 | | 5/2005 | |
| JP | 2005-122076 | A | 5/2005 | |
| JP | 2005-208228 | | 8/2005 | |
| JP | 2005-242115 | | 9/2005 | |
| JP | 2006-113212 | A | 4/2006 | |
| JP | WO2004100118 | | * 11/2007 | G09G 3/30 |
| JP | 2008-26395 | A | 2/2008 | |
| JP | 2009-20192 | A | 1/2009 | |
| KR | 2002-0025785 | A | 4/2002 | |
| KR | 10-2006-0017311 | A | 2/2006 | |
| KR | 10-2007-0006331 | A | 1/2007 | |

* cited by examiner (a)

(b)

IMAGE DISPLAY DEVICE, CONTROL METHOD FOR AN IMAGE DISPLAY DEVICE, AND ADJUSTMENT SYSTEM FOR AN IMAGE DISPLAY DEVICE

TECHNICAL FIELD

The present invention relates to an image display device.

BACKGROUND ART

There has been conventionally known an image display device including organic electroluminescence (EL) elements in which electroluminescence is used.

In the image display device as described above, temperature of an organic EL panel changes due to temperature characteristics of a thin film transistor (TFT) and the organic EL element, and accordingly light-emitting luminance changes.

Therefore, there is proposed a technology of appropriately controlling a signal waveform, signal voltage or power supply voltage to be provided to a pixel circuit of an organic EL element to stabilize light-emitting luminance with respect to a temperature change of an organic EL panel in a wide temperature range (for example, from −20° C. to +60° C.) (for example, Japanese Patent Application Laid-Open No. 07-263142, Japanese Patent Application Laid-Open No. 2000-214824, Japanese Patent Application Laid-Open No. 2001-118676, Japanese Patent Application Laid-Open No. 2001-343932, Japanese Patent Application Laid-Open No. 2003-29710, Japanese Patent No. 3389653, Japanese Patent Application Laid-Open No. 2003-150113, Japanese Patent Application Laid-Open No. 2003-330419, Japanese Patent Application Laid-Open No. 2004-102077, Japanese Patent Application Laid-Open No. 2005-55909, Japanese Patent Application Laid-Open No. 2005-208228, Japanese Patent Application Laid-Open No. 2005-242115, Japanese Patent Application Laid-Open No. 2005-309232 and Japanese Patent Application Laid-Open No. 2005-316139). For example, when the signal waveform is changed for each temperature segment in increments of approximately 3° C., luminance can be suppressed from fluctuating to such an extent that a luminance change is not apparent even between temperature segments.

However, a manner in which temperature of the organic EL panel is measured to adjust luminance with respect to a temperature change thereof is adaptable to a temperature change in an initial state, but is not adaptable to a characteristic change over time due to degradation of the organic EL panel or the like. That is, the light-emitting luminance of the image display device cannot be kept constant for the same image data when a characteristic of the TFT or the organic EL element changes over time.

Further, when light-emitting is controlled in accordance with a temperature change, there is required a certain length of period for the temperature of the organic EL panel to follow the temperature change after the control, which is likely to result in a delay in control.

The problems as described above are typically common in image display devices in which light-emitting luminance changes due to a characteristic change over time or temperature change.

DISCLOSURE OF INVENTION

The present invention has been made in view of the above-mentioned problems, and an object thereof is to provide a technology capable of stabilizing light-emitting luminance of an image display device.

According to a first aspect of the present invention, an image display device includes a pixel circuit including a light-emitting element, a recognizing portion which recognizes a predicted value of a parameter on driving of the pixel circuit based on image data, and an obtaining portion which obtains an actually-measured value of the parameter while causing the light-emitting element to emit light in accordance with the image data. This image display device further includes a comparing portion which compares the predicted value and the actually-measured value with each other, and a control portion which controls a power supply voltage applied to the pixel circuit in accordance with a comparison result of the comparing portion. The control portion increases/decreases, in response to a fact that the actually-measured value falls outside a first reference range with the predicted value being as a reference, the power supply voltage so that the actually-measured value is included in a second reference range which is within the first reference range and is narrower than the first reference range, and stops the increase/decrease of the power supply voltage in a case where a relationship in which the actually-measured value is included in the second reference range is satisfied.

According to a second aspect of the present invention, a control method for an image display device, which includes a pixel circuit including a light-emitting element, includes the steps of recognizing a predicted value of a parameter on driving of the pixel circuit based on image data, and obtaining an actually-measured value of the parameter while causing the light-emitting element to emit light in accordance with the image data. This control method further includes the steps of increasing/decreasing the power supply voltage in response to a fact that the actually-measured value falls outside a first reference range with the predicted value being as a reference, and stopping the increase/decrease of the power supply voltage if a relationship in which the actually-measured value is included in a second reference range which is within the first reference range and is more narrow than the first reference range is satisfied.

According to a third aspect of the present invention, an adjustment system for an image display device, which includes a pixel circuit including a light-emitting element, includes an image display device and an external circuit connected to the image display device. The image display device includes a recognizing portion which recognizes a predicted value of a parameter on driving of the pixel circuit based on image data, an obtaining portion which measures a value of the parameter while causing the light-emitting element to emit light in accordance with the image data, to thereby obtain an actually-measured value of the parameter, and a comparing portion which compares the predicted value and the actually-measured value with each other. The external circuit includes a control portion which controls a power supply voltage applied to the pixel circuit in accordance with a comparison result of the comparing portion. The control portion increases/decreases, in response to a fact that the actually-measured value falls outside a first reference range with the predicted value being as a reference, the power supply voltage so that the actually-measured value is included in a second reference range which is within the first reference range and is narrower than the first reference range, and stops the increase/decrease of the power supply voltage if a relationship in which the actually-measured value is included in the second reference range is satisfied.

BEST MODE FOR CARRYING OUT THE INVENTION

Figure 1:
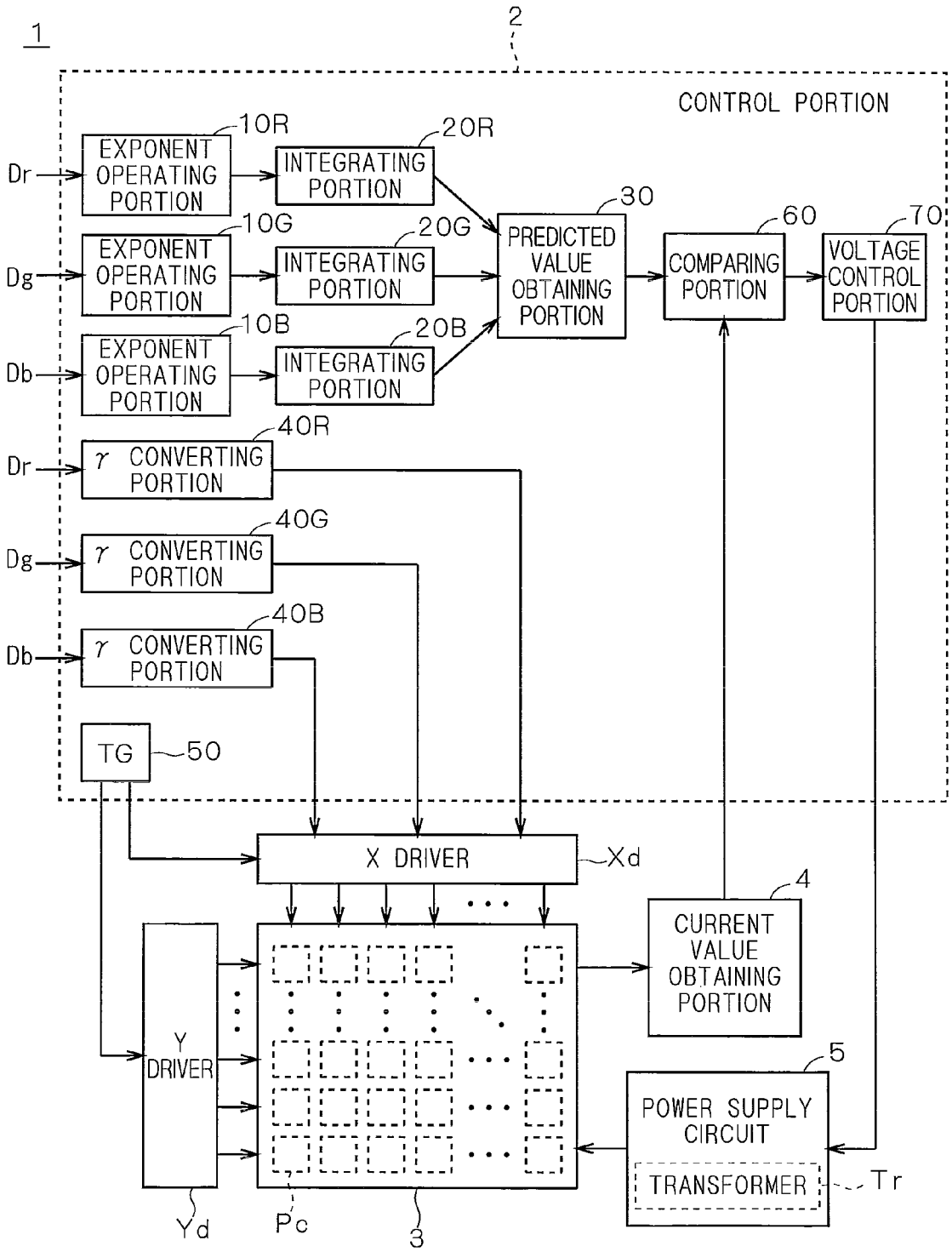
FIG. 1 is a block diagram showing a functional structure of an image display device according to an embodiment of the present invention.

An embodiment of the present invention will be described below with reference to drawings.

(Functional structure of image display device)

An image display device 1 mainly includes a control portion 2 as control portion, an organic EL panel 3, a current value obtaining portion 4 as obtaining portion, a power supply circuit 5, an X driver Xd and a Y driver Yd. Note that it is assumed here that image data is composed of image signals of three primary colors, red (R), green (G) and blue (B), and that the organic EL panel 3 includes a light-emitting element which emits light of red color, a light-emmitting element which emits light of green color and a light-emitting element which emits light of blue color.

The control portion 2 is a part which performs overall control on an operation of the image display device 1, and includes a CPU, ROM, RAM and the like. For example, the ROM stores a program and various types of data, and the CPU reads and executes the program stored in the ROM, whereby various types of control and functions of the control portion 2 can be realized.

This control portion 2 calculates a predicted value of current consumed by the organic EL panel 3 from the image data. Then, the control portion 2 compares this predicted value and current (actually-measured value) actually consumed by the organic EL panel 3 due to light-emitting corresponding to the image data, and adjusts voltage to be provided to the organic EL panel 3 so that the predicted value and the actually-measured value substantially coincide with each other.

A function of controlling current and voltage for driving the organic EL panel 3 will be described below.

As shown in FIG. 1, the program is executed by the control portion 2, with the result that exponent operating portions 10R, 10G and 10B, integrating portions 20R, 20G and 20B, predicted value obtaining portion 30, γ converting portions 40R, 40G and 40B, a timing generator (TG) 50, a comparing portion 60 and a voltage control portion 70 are realized as a functional structure.

The exponent operating portions 10R, 10G and 10B receive image data in which values (that is, pixel values) indicated by data signals of colors corresponding to respective pixels are denoted by Dr, Dg and Db. Then, the exponent operating portions 10R, 10G and 10B perform an operation of an exponential function with the pixel values Dr, Dg and Db being as bases of the respective colors and a predetermined value (in this case, 2.2) being as an exponent.

Here, a figure "gamma (γ)" is used for expressing response characteristics of a gradation of images. For example, in a case of a display, brightness of a surface thereof is not directly proportional to input voltage and changes exponentially. Brightness changes gradually when the input voltage is small, while a change in brightness increases abruptly when the input voltage is large. For example, it is assumed that gamma is 2.2 when this relation is indicated by a curve of 2.2-th power. This gamma (γ) is an exponent for determining the gradation of image quality is hard or soft. The gradation of image quality becomes hard when γ is relatively large and becomes soft when γ is relatively small.

In a case of an organic EL panel, γ=2.2 is typically used. Accordingly, when a pixel value X of image data is raised to the 2.2-th power, image signals to be provided to the respective pixels, that is, values of data signals (pixel data signals) corresponding to light-emitting luminances of the respective light-emitting elements, that is, gradation is determined. This gradation is substantially proportional to currents consumed by the pixels of the respective colors.

For this reason, the exponent operating portions 10R, 10G and 10B respectively perform operations with the pixel values Dr, Dg and Db of the respective colors being as bases and 2.2 being as an exponent. Accordingly, currents consumed by the pixels of the respective colors are indirectly calculated.

Specifically, the exponent operating portion 10R calculates a value iR obtained by raising a pixel value Dr (for example, 0 to 63) of red color of image data (for example, image data of 6 bits) to the 2.2-th power. The exponent operating portion 10G calculates a value iG obtained by raising a pixel value Dg (for example, 0 to 63) of green color of the image data (for example, image data of 6 bits) to the 2.2-th power. The exponent operating portion 10B calculates a value iB obtained by raising a pixel value Db (for example, 0 to 63) of blue color of the image data (for example, image data of 6 bits) to the 2.2-th power.

For example, if the pixel value X expressed in 6 bits is 0/63, 1/63, 2/63, . . . and 63/63 and $0 \leq X \leq (63/63)$, a value obtained by raising the pixel value X to the 2.2-th power can be obtained approximately using the following expression (1). That is, an approximate value obtained by raising the pixel value X to the 2.2-th power can be obtained.

$$X^{2.2} \approx (3/4) \cdot X^2 + (1/4) \cdot X^3 = (1/4) \times (3X+1) \cdot X^2 \quad (1)$$

The integrating portions 20R, 20G and 20B perform cumulative addition on the values obtained by raising the pixel values to the 2.2-th power in the exponent operating portions 10R, 10G and 10B by the number of pixels of the organic EL panel 3 (for example, approximately 1,228,800 in total (1,280 in row and 960 in column)) for each color of R, G and B.

More specifically, the integrating portion 20R calculates a value SumR obtained by performing cumulative addition on the value iR, which is obtained by raising the pixel value Dr to the 2.2-th power, by the number of pixels of red color of the organic EL panel 3. The integrating portion 20G calculates a value SumG obtained by performing cumulative addition on the value iG, which is obtained by raising the pixel value Dg to the 2.2-th power, by the number of pixels of green color of the organic EL panel 3. The integrating portion 20B calculates a value SumB obtained by performing cumulative addition on the value iB, which is obtained by raising the pixel value Db to the 2.2-th power, by the number of pixels of blue color of the organic EL panel 3.

The predicted value obtaining portion 30 calculates, from the values SumR, SumG and SumB calculated by the integrating portions 20R, 20G and 20B, respectively, a predicted value (predicted current consumption) Ip of current predicted to be consumed by the organic EL panel 3 correspondingly to the image data in which the pixel values of the respective colors are Dr, Dg and Db.

Here, the maximum values of the currents consumed by the light-emitting elements of three colors, R, G and B, differ in accordance with setting of white balance of the organic EL panel 3. For this reason, coefficients Cr, Cg and Cb, which are determined in advance in consideration of design and are different from each other among R, G and B, are multiplied by the value SumR, the value SumG and the value SumB, respectively, and added together, whereby the predicted current consumption Ip is calculated.

Specifically, the predicted current consumption Ip is calculated using the following expression (2).

$$Ip=Cr\times\Sigma iR+Cg\times\Sigma iG+Cb\times\Sigma iB=Cr\times\mathrm{Sum}R+Cg\times\mathrm{Sum}G+Cb\times\mathrm{Sum}B \quad (2)$$

In this manner, the value obtained by raising the respective pixel values of image data to the 2.2-th power is added for an entire screen of the organic EL panel 3 by the exponent operating portions 10R, 10G and 10B, the integrating portions 20R, 20G and 20B, and the predicted value obtaining portion 30 as a recognizing portion. Then, the predicted current consumption Ip of the organic EL panel 3 is calculated. That is, as to the image data, the predicted value (predicted current consumption) Ip of current consumed in driving of a plurality of pixel circuits Pc arranged in the entire screen of the organic EL panel 3 are recognized based on the above-mentioned operation of the control portion 2.

The γ converting portions 40R, 40G and 40B receive image data in which the pixel values of the respective colors are Dr, Dg and Db, to thereby perform so-called gamma correction. Here, the pixel values Dr, Dg and Db of the respective colors are converted into values raised approximately to the 2.2-th power.

More specifically, the γ converting portion 40R converts the pixel value Dr into an image data signal (that is, gradation) obtained by raising the pixel value Dr approximately to the 2.2-th power. The γ converting portion 40G converts the pixel value Dg into an image data signal (that is, gradation) obtained by raising the pixel value Dg approximately to the 2.2-th power. The γ converting portion 40B converts the pixel value Db into an image data signal (that is, gradation) obtained by raising the pixel value Db approximately to the 2.2-th power. Through this conversion, the image signal is converted into an image signal of 10 bits (that is, image signal in which a pixel value is 0 to 1023). The image signal after conversion is input to the X driver Xd.

Note that as to the conversion processing of the γ converting portions 40R, 40G and 40B, there may be prepared a table in which a value before conversion and a value after conversion are associated with each other, and then this table may be referred to.

Alternatively, the conversion processing may be performed point by point through operation.

The TG 50 outputs signals for controlling operations of the X driver Xd and the Y driver Yd to the X driver Xd and the Y driver Yd, respectively.

This comparing portion 60 compares the predicted current consumption Ip obtained by the predicted value obtaining portion 30 and an actually-measured value (actually-measured current consumption) Ir of current consumption of the organic EL panel 3 which is input from the current value obtaining portion 4 (described below) with each other, to thereby output a control signal corresponding to a comparison result to the voltage control portion 70.

The voltage control portion 70 controls, in accordance with the comparison result of the comparing portion 60, power supply voltage applied to the plurality of pixel circuits Pc arranged in the organic EL panel 3, in this case, power supply voltage applied to both ends of the light-emitting elements included in the respective pixel circuits Pc. More specifically, the voltage control portion 70 transmits a control signal for controlling a transformer Tr of the power supply circuit 5.

The organic EL panel 3 is an organic electroluminescence (EL) display having a roughly rectangular shape, and is a self-emission type image display device including self-emission type light-emitting elements whose organic material emits light when current is caused to flow therethrough.

In this organic EL panel 3, a large number of pixel circuits Pc are arranged, and each of the pixel circuits Pc includes the light-emitting elements (here, organic EL elements). A large number of light-emitting elements are arranged in, for example, a grid pattern.

Further, the organic EL panel 3 includes image signal lines for supplying a data signal (pixel data signal) corresponding to light-emitting luminance to the respective pixel circuits Pc, and scanning signal lines, which are provided to be substantially orthogonal to the image signal lines, for supplying a scanning signal to the respective pixel circuits Pc. Note that the scanning signal controls a timing at which the image data signal is supplied to the respective pixel circuits Pc via the pixel signal lines.

The X driver Xd is a circuit (image signal line driving circuit) which is electrically connected to the image signal lines and controls the timing at which the pixel data signal is supplied to the image signal lines.

The Y driver Yd is a circuit (scanning signal line driving circuit) which controls a timing at which the scanning signal is supplied to the scanning signal lines.

Note that in the image display device 1, for example, the X driver Xd is disposed along one side (for example, short side or long side) of the organic EL panel 3, and the Y driver Yd is disposed along the other side (for example, long side or short side) of the organic EL panel 3, which is substantially orthogonal to the one side thereof.

The current value obtaining portion 4 actually measures current (power supply current) which is supplied from the power supply circuit 5 and consumed by the organic EL panel 3 while causing the respective light-emitting elements to emit light in accordance with the image data, to thereby obtain the actually-measured value (actually-measured current consumption) Ir of the current consumption of the organic EL panel 3.

This current value obtaining portion 4 includes an ammeter and the like. For example, a resistor is provided in a circuit extending from the power supply circuit 5 to the organic EL panel 3, and the ammeter is connected between both ends of the resistor.

Further, the current value obtaining portion 4 measures the current consumption at a predetermined timing during a light-emitting period for one frame in which the respective light-emitting elements of the organic EL panel 3 emit light. Here, the current consumption is measured at predetermined timings during the light-emitting periods of the respective frames.

The power supply circuit 5 supplies power supplied from a power source (for example, battery) to the respective pixels of the organic EL panel 3 based on the control signal from the control portion 2. More specifically, power is supplied to the light-emitting elements included in the respective pixel circuits.

This power supply circuit 5 changes the power supplied to the respective pixel circuits of the organic EL panel 3 by the transformer (for example, DC-DC converter) Tr in response to the control signal from the voltage control portion 70. That is, the power supply voltage, which is applied between both poles of the light-emitting elements included in the respective pixel circuits, is changed. For example, in this case, power supply voltage is changed for each one frame. More specifically, the power supply voltage is changed between the light-emitting period for one frame and the following light-emitting period for one frame. Then, through this change of the power supply voltage, the current consumption of the organic EL panel 3 is changed.

Note that in this case, various functions of the control portion 2 are realized by executing a program by the CPU, but the present invention is not limited thereto. For example, all or part of the structure of the control portion 2 may be realized by a hardware structure of, for example, a dedicated electronic circuit.

(Method of Controlling Power Supply Voltage)

Figure 2:
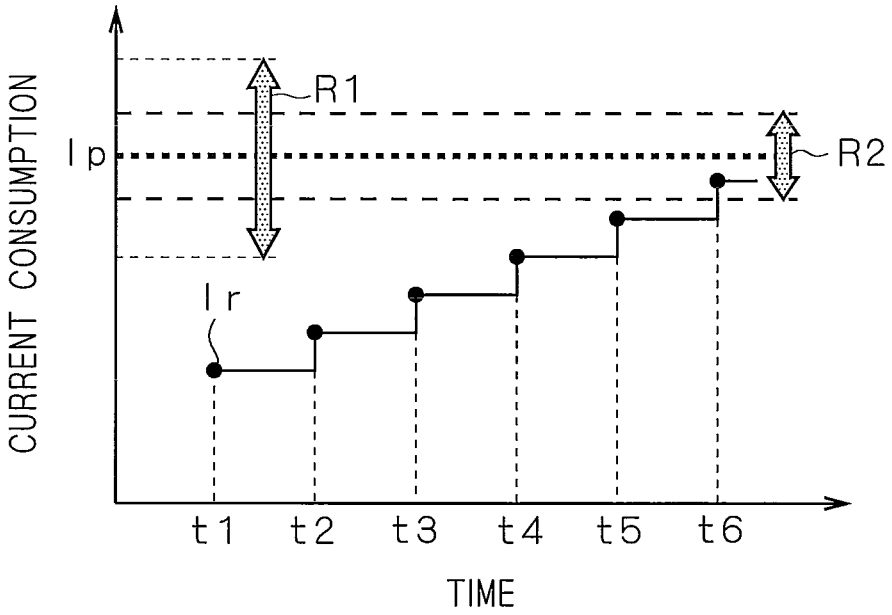
FIG. 2 and FIG. 3 are diagrams for describing an example of controlling power supply voltage.
Figure 2:
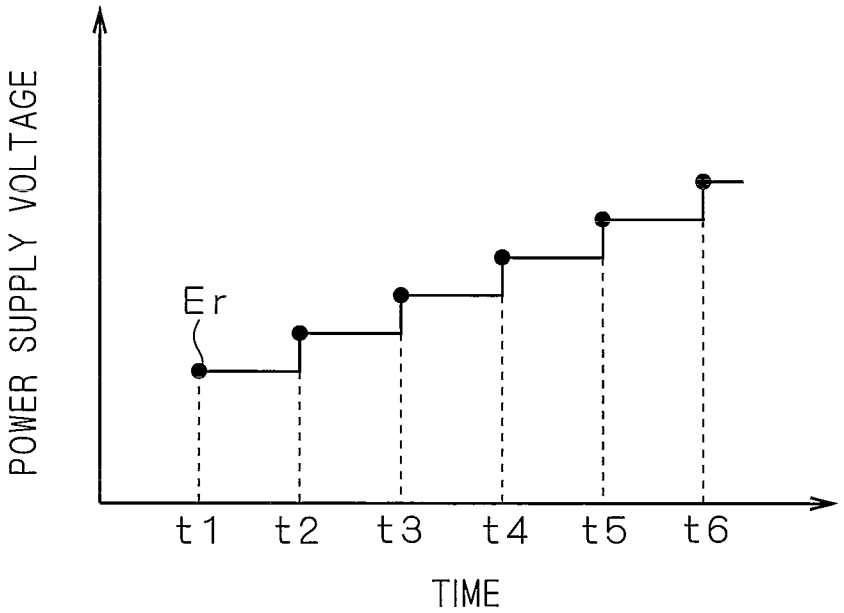
Figure 3:
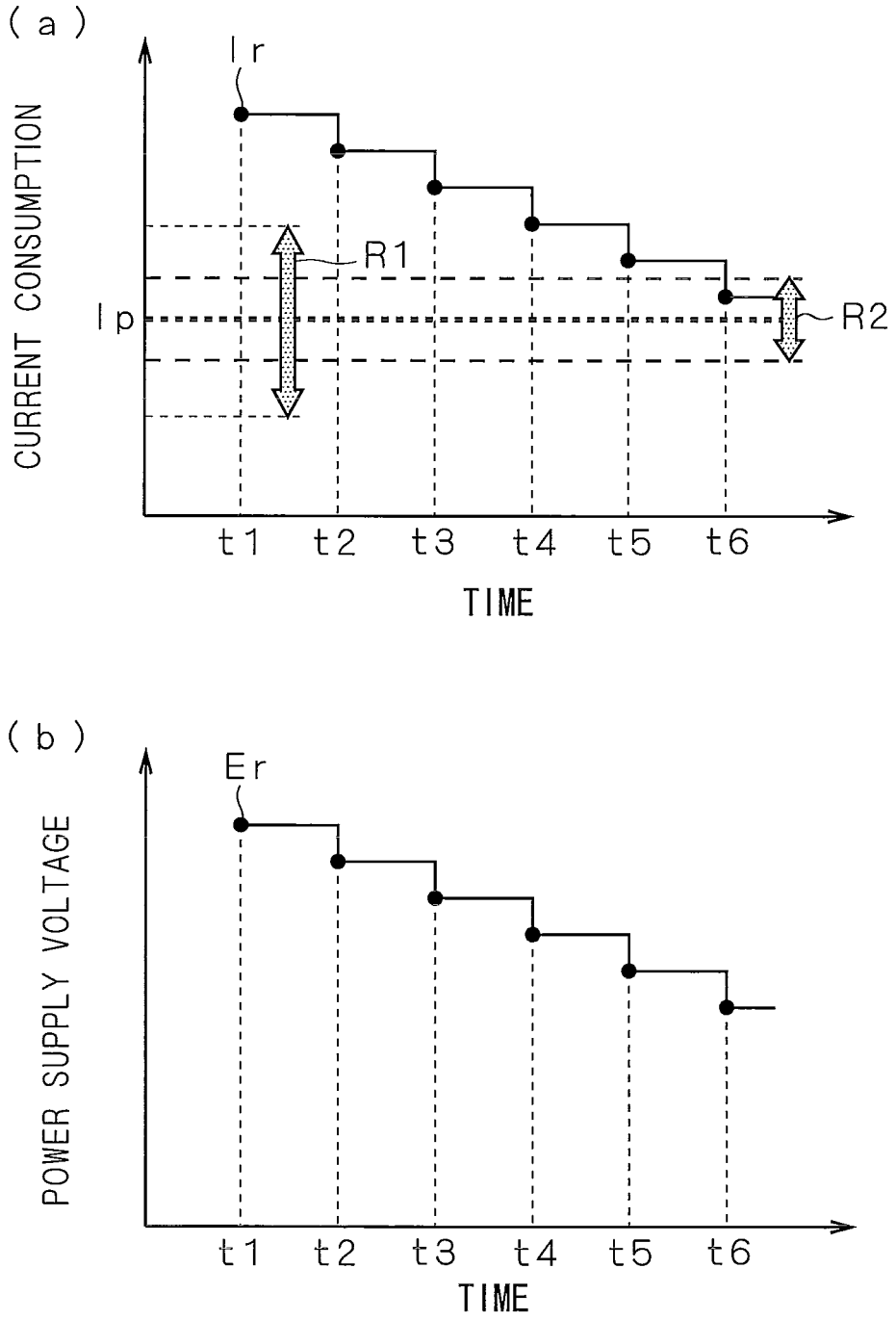

FIG. 2 and FIG. 3 are diagrams for describing an example of controlling power supply voltage. Here, description will be given by taking, as an example, a case in which image data, that is, the predicted current consumption Ip is constant during a certain length of period (from time t1 to time t6).

FIG. 2 show a control example of power supply voltage Er in a case where the actually-measured current consumption Ir falls outside a first reference range R1 with the predicted current consumption Ip being as a reference, and the comparing portion 60 recognizes that the actually-measured current consumption Ir is lower than the predicted current consumption Ip. Specifically, in FIG. 2(*a*), a vertical axis and a horizontal axis represent current consumption and time, respectively, and a change over time in actually-measured current consumption Ir (indicated by a black dot and solid line) is shown. In FIG. 2(*b*), a vertical axis and a horizontal axis represent power supply voltage and time, respectively, and a change over time in power supply voltage Er (indicated by a black dot and solid line) is shown.

In a case where the actually-measured current consumption Ir is out of the first reference range R1 and the actually-measured current consumption Ir is lower than the predicted current consumption Ir (indicated by a bold broken line of FIG. 2(*a*)) (at time t1), the voltage control portion 70 and the power supply circuit 5 start increasing the power supply voltage Er. Here, the actually-measured current consumption Ir is lower than the predicted current consumption Ip due to a characteristic change over time or temperature change, and thus the power supply voltage Er is increased so that the actually-measured current consumption Ir rises.

For example, the first reference range R1 is set in a range with the predicted current consumption Ip being as a center. Specifically, the first reference range R1 is set as a predetermined range with the predicted current consumption Ip being as a reference (for example, within ±2% from the predicted current consumption Ip). In addition, single increase amount of the power supply voltage Er is set to a predetermined value (for example, voltage corresponding to an amount of one gradation of 10 bits, that is, a value in increments of 10 mV).

After that, the voltage control portion 70 and the power supply circuit 5 gradually increase the power supply voltage Er until the actually-measured current consumption Ir is included in a second reference range R2 with the predicted current consumption Ip being as a reference (from time t1 to time t6). Then, the increase/decrease of the power supply voltage Er is stopped when a relationship, in which the actually-measured current consumption Ir is included in the second reference range R2, is satisfied (at time t6).

The second reference range R2 is set in a range with the predicted current consumption Ip being as a center. In addition, the second reference range R2 is set to be relatively narrower than the first reference range R1. Further, the second reference range R2 is included in the first reference range R1. Specifically, the second reference range R2 is set in a predetermined range (for example, within ±1%) with the predicted current consumption Ip being as a reference.

The voltage control portion 70 and the power supply circuit 5 respond to a fact that the actually-measured current consumption Ir falls outside the first reference range R1 with the predicted current consumption Ip being as a center. Specifically, in a case where the actually-measured current consumption Ir is lower than the predicted current consumption Ip, the voltage control portion 70 and the power supply circuit 5 gradually increase the power supply voltage Er until the actually-measured current consumption Ir reaches the second reference range R2 with the predicted current consumption Ip being as the center.

FIG. 3 show a control example of the power supply voltage Er in a case where the actually-measured current consumption Ir falls outside the first reference range R1 with the predicted current consumption Ip being as the reference and the comparing portion 60 recognizes that the actually-measured current consumption Ir is higher than the predicted current consumption Ip. Specifically, in FIG. 3(*a*), a vertical axis and a horizontal axis represent current consumption and time, respectively, and a change over time in actually-measured current consumption Ir (indicated by a black dot and solid line) is shown. In FIG. 3(*b*), a vertical axis and a horizontal axis represent power supply voltage and time, respectively, and a change over time in power supply voltage Er (indicated by a black dot and solid line) is shown.

In a case where the actually-measured current consumption Ir is out of the first reference range R1 and the actually-measured current consumption Ir is higher than the predicted current consumption Ip (indicated by a bold broken line of FIG. 3(*a*)) (at time t1), the voltage control portion 70 and the power supply circuit 5 start decreasing the power supply voltage Er. Here, the actually-measured current consumption Ir is higher than the predicted current consumption Ip due to a characteristic change over time or temperature change, and thus the power supply voltage Er is decreased so that the actually-measured current consumption Ir is decreased. Note that single decrease amount of the power supply voltage Er is set to, for example, a predetermined value (for example, voltage corresponding to an amount of one gradation of 10 bits, that is, value in increments of 10 mV).

Then the voltage control portion 70 and the power supply circuit 5 gradually decrease the power supply voltage until the actually-measured current consumption Ir is included in the second reference range R2 with the predicted current consumption Ip being as the reference (from time t1 to time t6). After that, when the actually-measured current consumption Ir and the predicted current consumption Ip satisfy a predetermined relationship, an increase/decrease of the power supply voltage is stopped (at time t6).

In this manner, when the actually-measured current consumption Ir is higher than the predicted current consumption Ip, in response to the fact that the actually-measured current consumption Ir falls outside the first reference range R1 with the predicted current consumption Ip being as the center, the voltage control portion 70 and the power supply circuit 5 decrease the power supply voltage until the actually-measured current consumption Ir reaches the second reference range R2 with the predicted current consumption Ip being as the center.

Then, as described with reference to FIG. 2 and FIG. 3, when the actually-measured current consumption Ir falls within the second reference range R2 with the predicted current consumption Ip being as the reference, an increase/decrease of the power supply voltage is stopped. Accordingly, light-emitting luminance is promptly stabilized in accordance with a characteristic change over time or temperature change in the organic EL panel 3.

The first reference range R1 with the predicted current consumption Ip being as the reference, which is for defining a condition for starting an increase/decrease of the power supply voltage, is set to be wider than the second reference range R2 with the predicted current consumption Ip being as the reference, which is for defining a condition for stopping an increase/decrease of the power supply voltage. Through such setting, frequent changes in light-emitting luminance due to frequent changes in power supply voltage are reduced, with the result that the light-emitting luminance of the image display device 1 can be stabilized.

(Control Operation for Power Supply Voltage)

Figure 4:
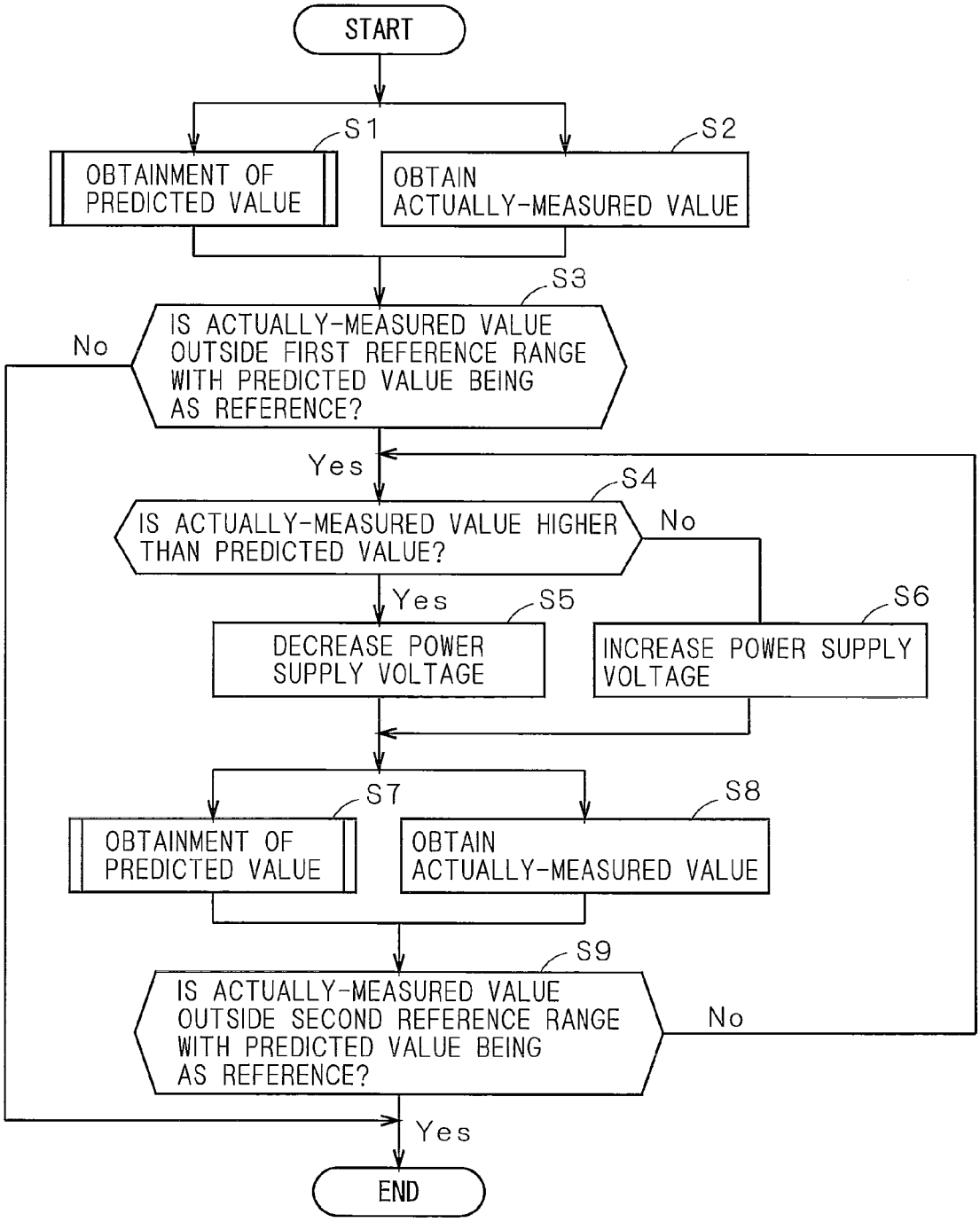
FIG. 4 and FIG. 5 are flowcharts showing an operation flow of controlling the power supply voltage.
Figure 5:
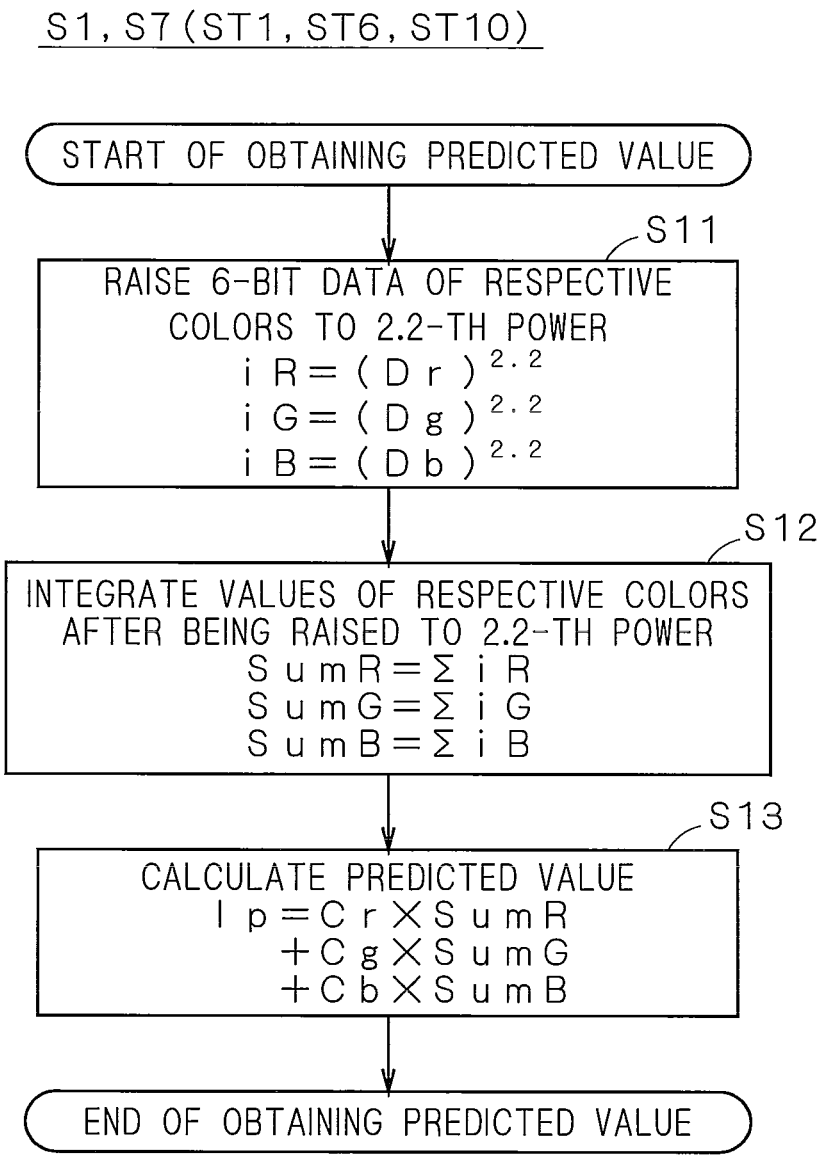

FIG. 4 and FIG. 5 are flowcharts showing a control operation flow for power supply voltage in the image display device 1. This operation flow is realized when a predetermined program is executed by the control portion 2, and for example, is started when the image data is input to the control portion 2.

First, in Step S1, a predicted value (predicted current consumption Ip in this case) is obtained by the exponent operating portions 10R, 10G and 10B, the integrating portions 20R, 20G and 20B, and the predicted value obtaining portion 30.

Specifically, as shown in FIG. 5, first, the exponent operating portions 10R, 10G and 10B calculate values iR, iG and iB obtained by raising 6-bit image signals of the respective colors to the 2.2-th power, respectively (Step S11). Then, the integrating portions 20R, 20G and 20B calculate values SumR, SumG and SumB obtained by performing cumulative addition on the values iR, iG and iB by the number of pixels of the respective colors of the organic EL panel 3 (Step S12). Further, the predicted value obtaining portion 30 calculates the predicted current consumption Ip from the values SumR, SumG and SumB (Step S13).

In Step S2, the current value obtaining portion 4 obtains an actually-measured value (actually-measured current consumption Ir in this case) at a predetermined timing during a light-emitting period for one frame.

In Step S3, the comparing portion 60 determines whether or not the actually-measured current consumption Ir obtained in Step S2 is out of the first reference range R1 with the predicted current consumption Ip obtained in Step S1 being as the reference. The process proceeds to Step S4 when the actually-measured current consumption Ir is out of the first reference range R1, whereas this operation flow is ended when the actually-measured current consumption Ir is not out of the first reference range R1.

In Step S4, the comparing portion 60 determines whether the actually-measured current consumption Ir is higher or lower than the predicted current consumption Ip. Here, if the actually-measured current consumption Ir is higher than the predicted current consumption Ip, the voltage control portion 70 and the power supply circuit 5 decrease the power supply voltage (Step S5). On the other hand, if the actually-measured current consumption Ir is lower than the predicted consumption power Ip, the voltage control portion 70 and the power supply circuit 5 increase the power supply voltage (Step S6). Note that in Steps S5 and S6, the power supply voltage is changed between the light-emitting periods for one frame of the organic EL panel 3.

In Step S7, the predicted current consumption Ip is obtained by a processing similar to that of Step S1. Note that the predicted current consumption Ip is obtained from image data of a frame following the frame in which the predicted current consumption Ip was obtained last time.

In Step S8, the actually-measured current consumption Ir is obtained by a processing similar to that of Step S2. This actually-measured current consumption Ir is obtained during a light-emitting period of a frame following the frame in which the actually-measured current consumption Ir was obtained last time.

In Step S9, the comparing portion 60 determines whether or not the actually-measured current consumption Ir falls within the second reference range R2 with the predicted current consumption Ip being as the reference. Here, the process proceeds to Step S4 when the actually-measured current consumption Ir does not fall within the second reference range R2. On the other hand, this operation flow is ended when the actually-measured current consumption Ir falls within the second reference range R2.

That is, the processings of Steps S4 to S9 are repeated until the actually-measured current consumption Ir falls within the second reference range R2.

The operation flow is executed in this manner, whereby, for example, the predicted current consumption Ip and the actually-measured current consumption Ir are obtained for image data of each frame. Then, in accordance with a comparison result therebetween, power supply voltage is switched between frames. For example, in a case where a frame rate is 1/60 seconds, the predicted current consumption Ip and the actually-measured current consumption Ir are compared with each other for each 1/60 seconds, and power supply voltage is appropriately adjusted.

As described above, in the image display device 1 according to the embodiment of the present invention, as to certain image data, a predicted value and an actually-measured value of a parameter (current in this case) on driving of a plurality of pixel circuits Pc are compared with each other, and power supply voltage is increased/decreased in accordance with a comparison result thereof. For this reason, in the organic EL element, it is possible to sufficiently keep light-emitting luminance with respect to the same image data even when voltage for operating the TFT or organic EL element changes due to a change over time in characteristic or a temperature change. That is, it is possible to stabilize light-emitting luminance of an image display device.

Further, the power supply voltage is set low, and hence power required for light-emitting of the organic EL panel 3 can be reduced. As a result, life of the organic EL panel 3 can be increased thanks to suppression of heat generation. In addition, it is possible to realize an environmentally-friendly image display device 1 which consumes less power, leading to $CO_2$ gas emission reduction.

Further, by a technique according to the embodiment of the present invention, as compared with a technology of measuring temperature of the organic EL panel 3 to control power supply voltage or the like to be provided to the pixel circuit Pc of the organic EL element based on this measurement result, it is possible to shorten time from a change of voltage to the light-emitting luminance becoming a desired value. This is because a characteristic that luminance of the organic EL element is approximately proportional to the power supply current (current value for driving of the pixel circuit) is used so that the measured value of the power supply current is reflected in adjustment of the power supply voltage.

Further, the power supply voltage is increased/decreased through the comparison between the actually-measured value of current which can be measured with a relatively simple structure and a predicted value thereof. For this reason, light-emitting luminance can be stabilized with respect to a characteristic change over time or temperature change without complicating the structure.

Further, for the entire screen of the organic EL panel 3, the predicted value and the actually-measured value of a predetermined parameter (current consumption in this case) on driving of a plurality of pixel circuits Pc are compared with each other, and the power supply voltage is increased/decreased in accordance with a comparison result thereof. For this reason, for the entire screen of the organic EL panel 3, a relationship between image data and a light-emitting state can be recognized collectively, whereby the light-emitting luminance can be efficiently stabilized with respect to a characteristic change over time or temperature change.

Further, the light-emitting state changes even during the light-emitting period for one frame, and thus the actually-measured value is measured at the same timing for one frame. Accordingly, the light-emitting luminance can be more accurately stabilized with respect to a characteristic change over time or temperature change.

Note that the present invention is not limited to the embodiment described above, and various modifications, improvements and the like can be made without departing from the scope of the invention.

(Modification 1)

In the embodiment described above, the power supply voltage is adjusted until the actually-measured current consumption Ir reaches the second reference range R2 with the predicted current consumption Ip being as the center. However, the present invention is not limited thereto.

For example, the power supply voltage may be adjusted until the actually-measured current consumption Ir reaches the predicted current consumption Ip. Specifically, the power supply voltage may be reduced until the actually-measured current consumption Ir is equal to or lower than the predict current consumption Ip if the actually-measured current consumption Ir is higher than the predicted current consumption Ip, and may be increased until the actually-measured current consumption Ir is equal to or higher than the predicted current consumption Ip if the actually-measured current consumption Ir is lower than the predicted current consumption Ip.

Figure 6:
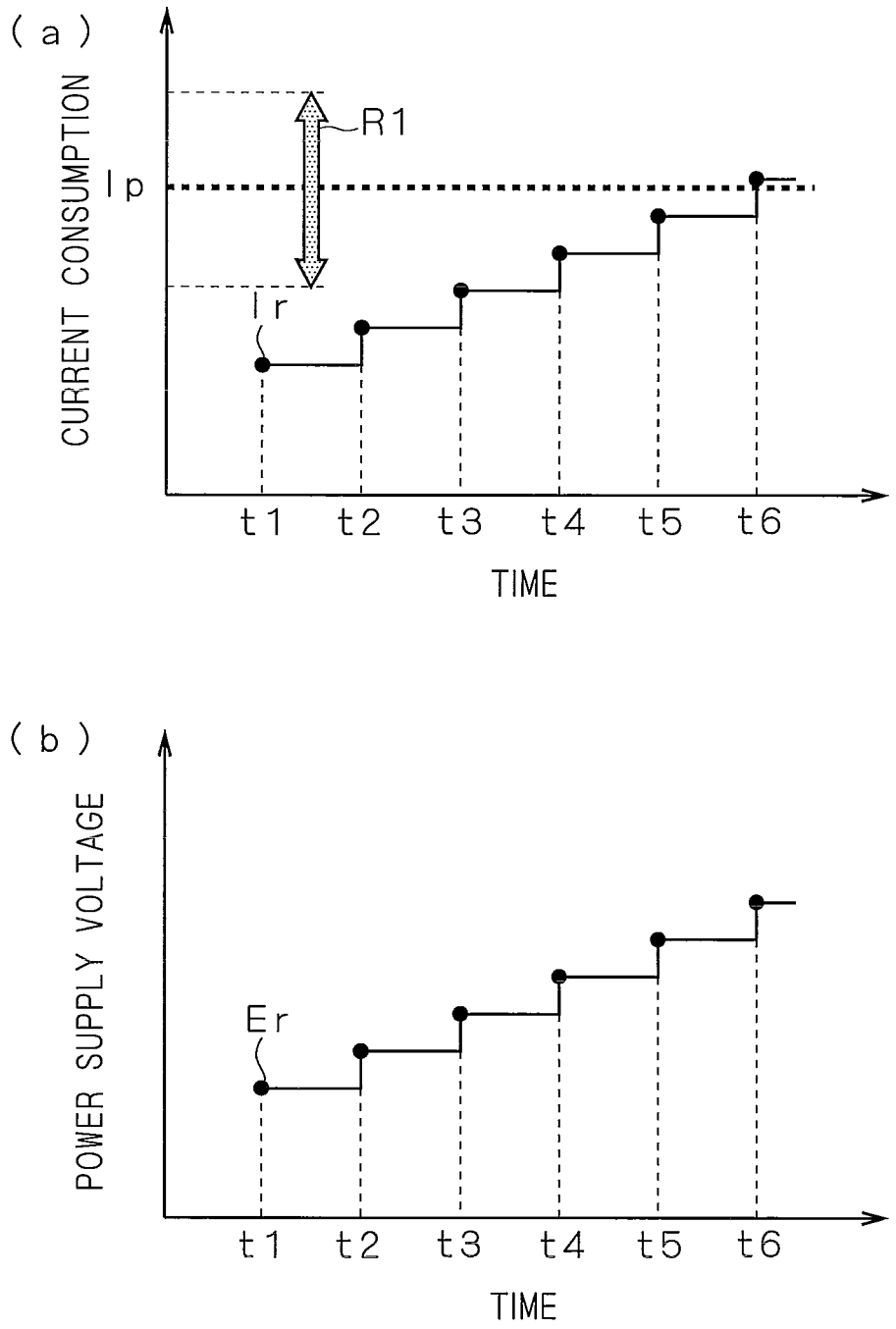
FIG. 6 and FIG. 7 are diagrams for describing an example of controlling power supply voltage according to Modification 1.
Figure 7:
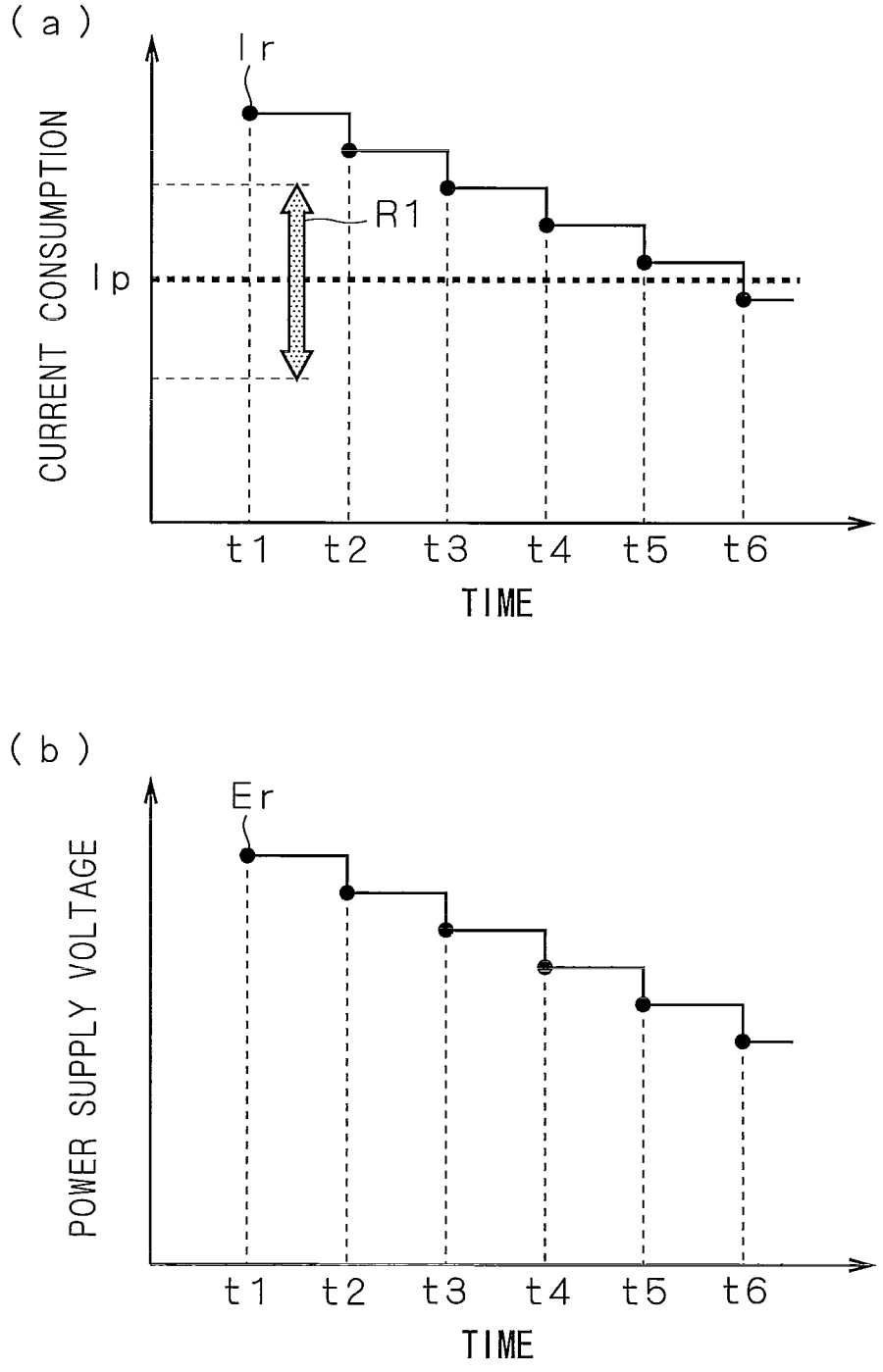

FIGS. 6 and 7 are diagrams for describing a control example of power supply voltage according to Modification 1. Here, as in the case of FIG. 2 and FIG. 3, description will be given by taking a case where the predicted current consumption Ip is constant during a certain period (from time t1 to time t6) as an example.

FIG. 6 show a control example of power supply voltage in a case where the actually-measured current consumption Ir falls outside the first reference range R1 with the predicted current consumption Ip being as the reference, and where the comparing portion 60 recognizes that the actually-measured current consumption Ir is lower than the predicted current consumption Ip. In addition, FIG. 7 show a control example of power supply voltage in a case where the actually-measured current consumption Ir falls outside the first reference range R1 with the predicted current consumption Ip being as the reference, and where the comparing portion 60 recognizes that the actually-measured current consumption Ir is higher than the predicted current consumption Ip. Specifically, as in the case of FIG. 2, in FIG. 6(*a*) and FIG. 7(*a*), a vertical axis and a horizontal axis represent current consumption and time, respectively, and a change over time in actually-measured current consumption Ir (indicated by a black dot or solid line) is shown. In FIG. 6(*b*) and FIG. 7(*b*), a vertical axis and a horizontal axis represent power supply voltage and time, respectively, and a change over time in power supply voltage Er (indicated by a black dot or solid line) is shown.

First, as shown in FIG. 6, in a case where the actually-measured current consumption Ir does not fall within the first reference range R1 and the actually-measured current consumption Ir is lower than the predicted current consumption Ip (indicated by a bold broken line of FIG. 6(*a*)) (at time t1), the voltage control portion 70 and the power supply circuit 5 start increasing the power supply voltage Er. Here, the actually-measured current consumption Ir is lower than the predicted current consumption Ip due to a characteristic change over time or temperature change, and thus the power supply voltage Er is increased so that the actually-measured current consumption Ir rises. Then, the power supply voltage Er is gradually increased (from time t1 to time t6) until the actually-measured current consumption Ir reaches the predicted current consumption Ip, that is, until the actually-measured current consumption Ir is equal to or higher than the predicted current consumption Ip. Then, when the actually-measured current consumption Ir reaches the predicted current consumption Ip, that is, when the actually-measured current consumption Ir is equal to or higher than the predicted current consumption Ip, an increase/decrease of the power supply voltage Er is stopped (at time t6).

As shown in FIGS. 7, in a case where the actually-measured current consumption Jr does not fall within the first reference range R1 and the actually-measured current consumption Ir is higher than the predicted current consumption Ip (indicated by a bold broken line of FIG. 7(*a*) (at time tl), the voltage control portion 70 and the power supply circuit 5 start decreasing the power supply voltage Er. In this case, the actually-measured current consumption Ir is higher than the predicted current consumption Ip due to a characteristic change over time or temperature change, and thus the power supply voltage Er is decreased so that the actually-measured current consumption Ir decreases. Then, the power supply voltage Er is decreased so that the actually-measured current consumption Jr reaches the predicted current consumption Ip, that is, so that the actually-measured current consumption Ir is equal to or lower than the predicted current consumption Ip (from time tl to time t6). Then, when the actually-measured current consumption Jr reaches the predicted current consumption Ip, that is, when the actually-measured current consumption Jr is equal to or lower than the predicted current consumption Ip, an increase/decrease of the power supply voltage Er is stopped (at time t6).

Figure 8:
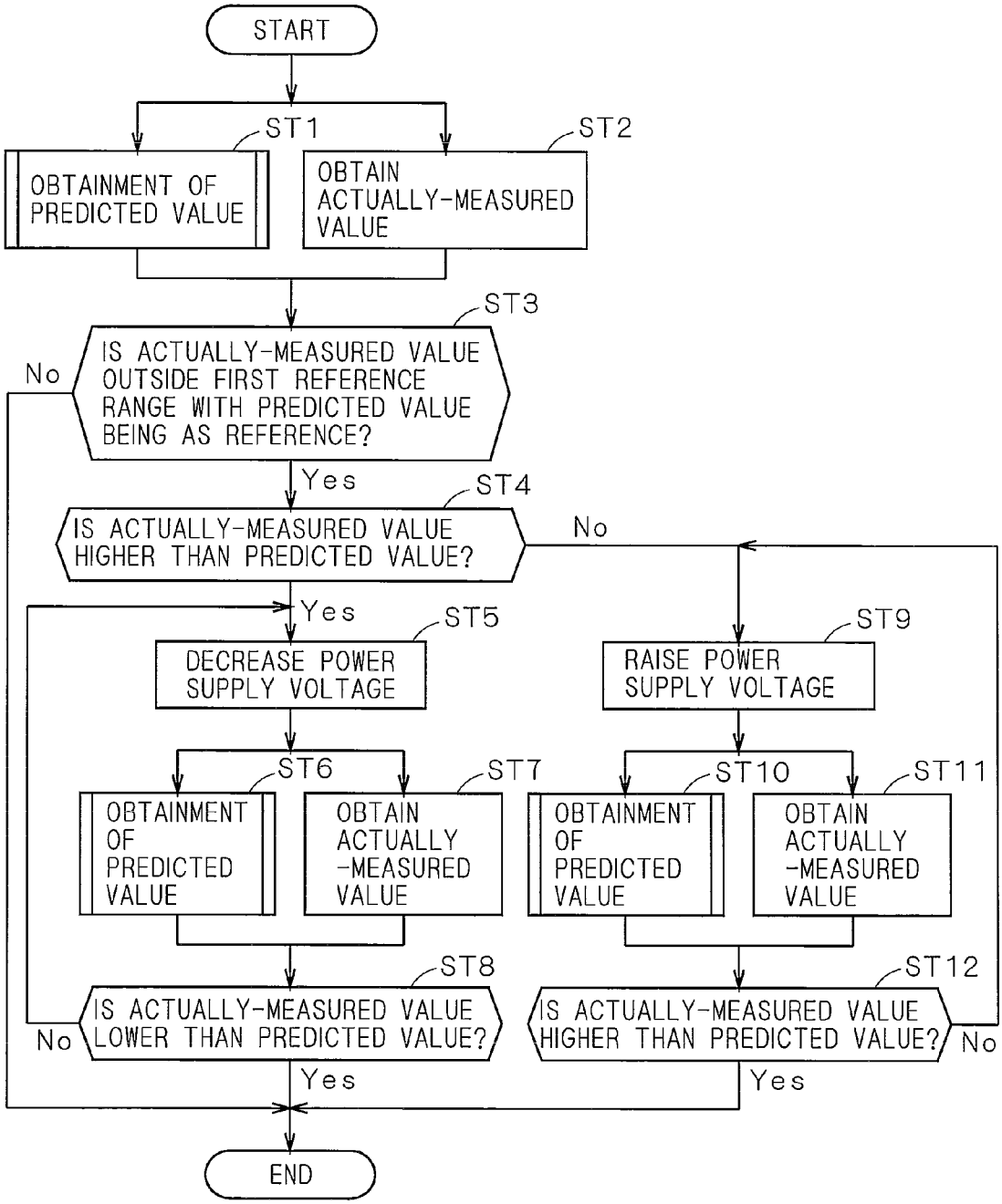
FIG. 8 is a flowchart showing the operation flow of controlling the power supply voltage according to Modification 1.

FIG. 8 is a flowchart showing a control operation flow of the power supply voltage according to Modification 1. This operation flow is realized when a predetermined program is executed by the control portion 2, and for example, is started when the image data is input to the control portion 2.

First, processings similar to those of Steps S1 to S5 of FIG. 4 are performed in Steps ST1 to ST5.

In Steps ST6 and ST7, processings similar to those of Steps S1 and S2 of FIG. 4 are performed.

In Step ST8, it is determined whether or not an actually-measured value (actually-measured current consumption Ir in this case) is lower than a predicted value (predicted current consumption Ip in this case). Here, the process proceeds to Step ST5 when the actually-measured value is higher than the predicted value, while this operation flow is ended when the actually-measured value is lower than the predicted value.

That is, the processings of Steps ST5 to ST8 are repeated until the actually-measured current consumption Ir reaches the predicted current consumption Ip.

In Step ST9, a processing similar to that of Step S6 of FIG. 4 is performed, and in Steps ST10 and ST11, processings similar to those of Steps S1 and S2 of FIG. 4 are performed.

In Step ST12, it is determined whether the actually-measured value (actually-measured current consumption Ir in this case) is higher or lower than the predicted value (predicted current consumption Ip in this case). Here, the process proceeds to Step ST9 when the actually-measured value is lower than the predicted value, whereas this operation flow is ended when the actually-measured value is higher than the predicted value. That is, the processings of Steps ST9 to ST12 are repeated until the actually-measured current consumption Ir reaches the predicted current consumption Ip.

The operation flow as described above is executed, whereby the predicted current consumption Ip and the actually-measured current consumption Ir are obtained for, for example, the image data of each frame, and the power supply voltage is switched between light-emitting periods for each frame.

As described above, there is adopted a structure in which an increase/decrease of the power supply voltage is stopped when the actually-measured value reaches the predicted value, whereby it is possible to easily stabilize the light-emitting luminance with respect to a characteristic change over time or temperature change without setting the second reference range R2 and performing a complicated comparison operation as to whether or not the actually-measured value falls within the second reference range R2.

(Modification 2)

In the embodiment described above, the exponent operating portions 10R, 10G and 10B substitute the pixel values Dr, Dg and Db for an exponential function, to thereby calculate the values iR, iG and iB, which are obtained by raising the pixel values Dr, Dg and Db of the respective colors to the 2.2-th power, one by one, but the present invention is not limited thereto. For example, a storing portion or the like may store a data table (hereinafter, abbreviated to "table") in which the pixel values Dr, Dg and Db to be input and the values iR, iG and iB obtained by raising the pixel values Dr, Dg and Db to the 2.2-th power are associated with each other, and values obtained by raising the pixel values of the respective colors to the 2.2-th power may be obtained by referring to that table.

Figure 9:
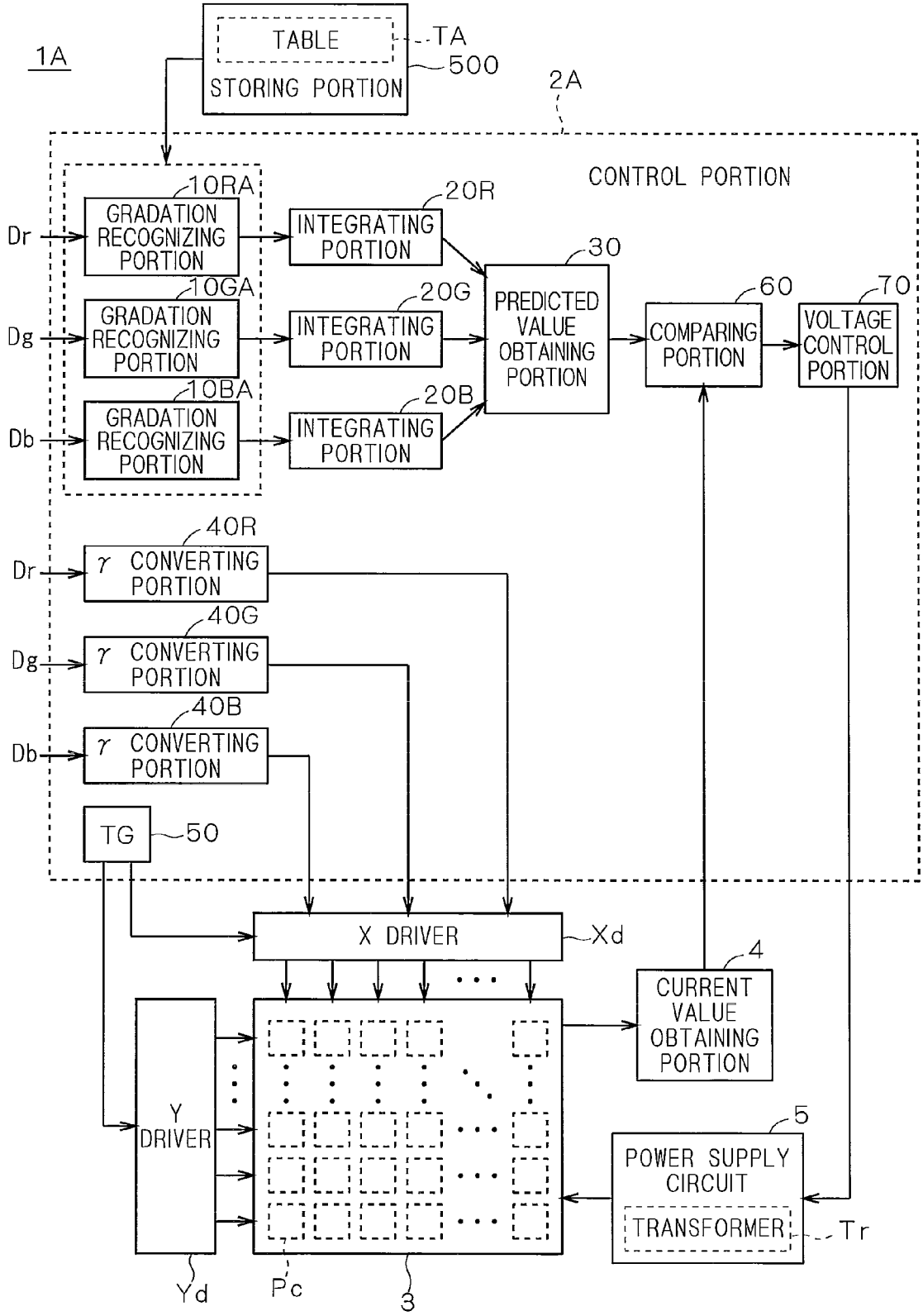
FIG. 9 is a block diagram showing a functional structure of an image display device according to Modification 2.

FIG. 9 is a block diagram showing a functional structure of an image display device 1A according to Modification 2. The image display device 1A is different from the image display device 1 according to the embodiment described above in that the exponent operating portions 10R, 10G and 10B and the control portion 2 are modified into gradation recognizing portions 10RA, 10GA and 10BA and a control portion 2A, respectively, and that a storing portion 500 which stores a table TA is added. The other structure is similar to that of the image display device 1, and thus like reference symbols are used and their description will be omitted. Note that in Modification 2, a recognizing portion is the gradation recognizing portions 10RA, 10GA and 10GB, the integrating portions 20R, 20G and 20B, the predicted value obtaining portion 30 and the storing portion 500.

The storing portion 500 includes a hard disk and the like, and stores the table TA. This table TA is a table in which the pixel values Dr, Dg and Db and the values iR, iG and iB obtained by raising the pixel values Dr, Dg and Db to the 2.2-th power are associated with each other. Note that the table TA may be stored in a ROM contained in the control portion 2A in place of being stored in the storing portion 500.

When the pixel values Dr, Dg and Db are input, the gradation recognizing portions 10RA, 10GA and 10BA refer to the table TA, to thereby recognize the values iR, iG and iB obtained by raising the pixel values Dr, Dg and Db of the respective colors to the 2.2-th power. Specifically, the gradation recognizing portion 10RA recognizes the value iR obtained by raising the pixel value Dr (for example, 0 to 63) of red color of the image data (for example, image data of 6 bits) to the 2.2-th power. The gradation recognizing portion 10GA recognizes the value iG obtained by raising the pixel value Dg (for example, 0 to 63) of green color of the image data (for example, image data of 6 bits) to the 2.2-th power. The gradation recognizing portion 10BA recognizes the value iB obtained by raising the pixel value Db (for example, 0 to 63) of blue color of the image data (for example, image data of 6 bits) to the 2.2-th power.

Note that the integrating portions 20R, 20G and 20B perform the cumulative addition on the values iR, iG and iB obtained by raising the pixel values Dr, Dg and Db to the 2.2-th power recognized by the gradation recognizing portions 10RA, 10GA and 10BA by the number of pixels of the organic EL panel 3 for each color.

In this manner, there is prepared information in which the pixel values Dr, Dg and Db and the values iR, iG and iB obtained by raising the pixel values Dr, Dg and Db to the 2.2-th power are associated with each other, whereby an operation amount can be reduced. That is, the processing can be executed faster.

Incidentally, in an organic EL element, there is shown an approximately proportional relationship between flowing current and light-emitting luminance. Strictly speaking, there is a tendency that efficiency (that is, current efficiency) in which flowing current is converted into light is slightly decreased as the current increases.

Accordingly, at a stage of design, current by which desired luminance can be obtained with respect to the pixel values Dr, Dg and Db is measured in advance while measuring luminance when the organic EL panel 3 emits light with a luminance meter. Then, there may be prepared a table in which a combination of the pixel values Dr, Dg and Db and the predicted current consumption Ip are associated with each other so that the predicted current consumption Ip corresponding to the pixel values Dr, Dg and Db of the respective colors is obtained by referring to the table.

With the structure as described above, it is possible to stabilize light-emitting luminance with respect to a characteristic change over time or temperature change with high accuracy also in consideration of an effect of current efficiency.

(Modification 3)

In Modification 1 described above, the power supply voltage of the organic EL panel 3 is controlled in accordance with the comparison result between the predicted current consumption Ip and the actually-measured current consumption Ir, but the present invention is not limited thereto.

For example, luminance of light emitted from the plurality of light-emitting elements included in the plurality of pixel circuits Pc of the organic EL panel 3 may be set as a parameter. In this case, first, a predicted value of luminance of light emitted from the organic EL panel 3 with respect to certain image data is recognized based on a rule determined in advance. Then, an actual value thereof is obtained, whereby the power supply voltage of the organic EL panel 3 may be controlled in accordance with a comparison result between the predicted value and the actually-measured value.

With the structure as described above, the power supply voltage is increased/decreased through the comparison between an actually-measured value which is directly linked to how the screen is actually viewed and a predicted value thereof. Accordingly, it is possible to stabilize light-emitting luminance with respect to a characteristic change over time or temperature change with high accuracy.

Figure 10:
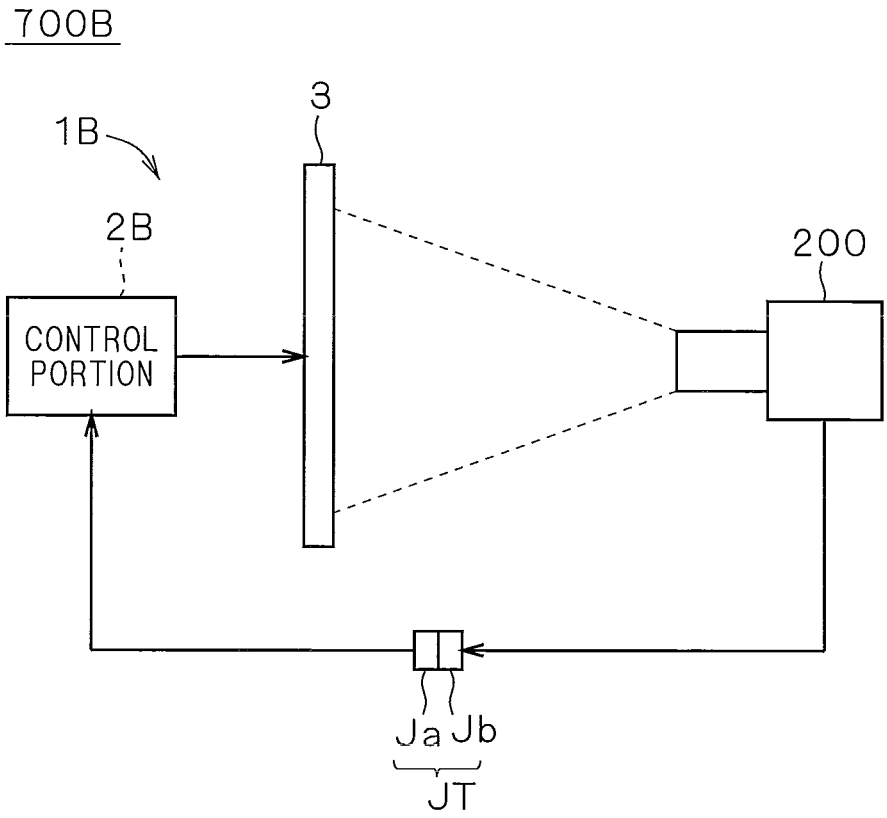
FIG. 10 is a diagram showing an outline of an adjustment system according to Modification 3.

FIG. 10 is a diagram showing an outline of an adjustment system 700B which adjusts an image display device 1B according to Modification 3.

The adjustment system 700B includes the image display device 1B and a luminance obtaining portion 200. Here, the luminance obtaining portion 200 is configured separately from the image display device 1B, and includes a luminance meter for measuring luminance of light emitted from the organic EL panel 3 from a front side thereof.

This luminance obtaining portion 200 is connected to the image display device 1B so as to transmit data thereto via a cable and a connection portion JT. More specifically, a terminal Jb at an edge of the cable drawn from the luminance obtaining portion 200 is electrically connected to a terminal Ja provided in the image display device 1B, to thereby form the connection portion JT.

In order to allow the luminance obtaining portion 200 to correctly measure luminance of light emitted from the organic EL panel 3 from the front side of the organic EL panel 3, for example, the luminance obtaining portion 200 is fixedly installed on a given base, and the image display device 1B is fitted with a given groove portion provided in the base. Accordingly, configuration is preferably made so that a positional relationship between the luminance obtaining portion 200 and the organic EL panel 3 meets a predetermined setting condition.

Figure 11:
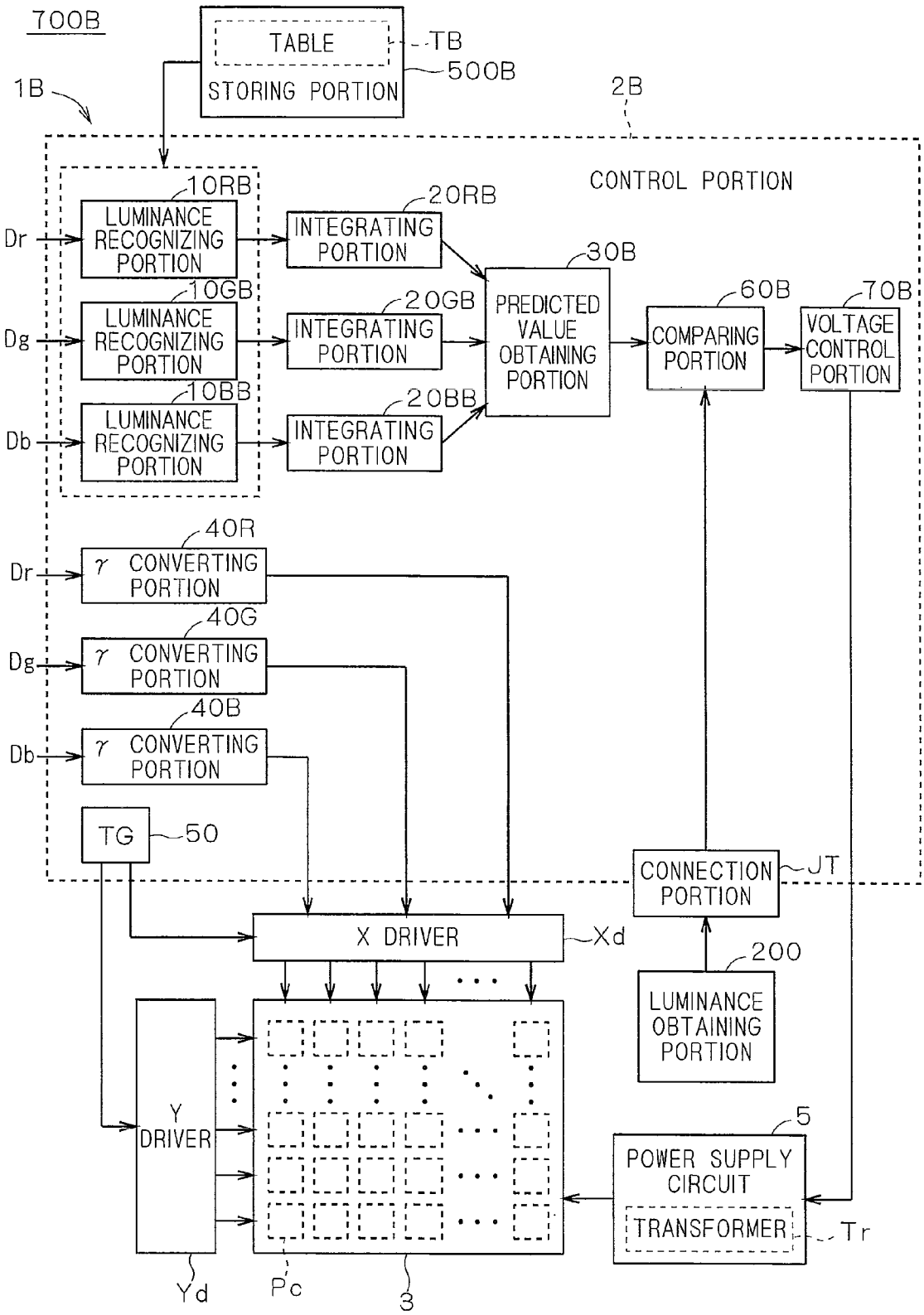
FIG. 11 is a block diagram showing a functional structure of the adjustment system according to Modification 3.

FIG. 11 is a block diagram showing a functional structure of the adjustment system 700B which adjusts the image display device 1B according to Modification 3. Here, like reference symbols are used to denote the structure similar to that of the embodiment described above, and description thereof will be omitted. Note that in Modification 3, the recognizing portion is luminance recognizing portions 10RB, 10GB and 10BB, integrating portions 20RB, 20GB and 20BB, a predicted value obtaining portion 30B and a storing portion 500B.

The adjustment system 700B includes a control portion 2B, the organic EL panel 3, a luminance obtaining portion 200, the power supply circuit 5, the X driver Xd, the Y driver Yd and a storing portion 500B.

The storing portion 500B stores a data table (table) TB indicating a relationship between the pixel values Dr, Dg and Db and luminance. This table TB may store a value, which is obtained through actual measurement using a luminance meter or the like, as an initial value in advance in association with, for example, the pixel values Dr, Dg and Db.

In the control portion 2B, a predetermined program stored in the ROM or the like is executed, whereby various functions or operations are executed.

Specifically, the luminance recognizing portions 10RB, 10GB and 10BB receive image data in which values (that is, pixel values) indicated by data signals of respective colors corresponding to the respective pixels are Dr, Dg and Db, and refer to the table TB, to thereby recognize luminances Pr, Pg and Pb corresponding thereto, respectively. More specifically, the luminance recognizing portion 10RB recognizes the luminance Pr corresponding to the pixel value Dr of red color. The luminance recognizing portion 10GB recognizes the luminance Pg corresponding to the pixel value Dg of green color. The luminance recognizing portion 10BB recognizes the luminance Pb corresponding to the pixel value Db of blue color.

The integrating portions 20RB, 20 GB and 20BB perform cumulative addition on the luminances Pr, Pg and Pb recognized by the luminance recognizing portion 10RB, 10GB and 10BB by the number of pixels of the organic EL panel 3 for each color. More specifically, the integrating portion 20RB calculates an integrated value SumPr of luminance of red color. The integrating portion 20GB calculates an integrated value SumPg of luminance of green color. The integrating portion 20BB calculates an integrated value SumPb of luminance of blue color.

The predicted value obtaining portion 30B adds the integrated values SumPr, SumPg and SumPb together, to thereby recognize (obtain) a predicted value (hereinafter, also referred to as "predicted luminance") of luminance of light emitted from the organic EL panel 3.

A comparing potion 60B obtains an actually-measured value (hereinafter, also referred to as "actually-measured luminance") of luminance of the organic EL panel 3 which is obtained by the luminance obtaining portion 200 via the connection portion JT. Then, the comparing portion 60B compares the predicted luminance and the actually-measured luminance with each other, to thereby output a control signal corresponding to a comparison result to a voltage control portion 70B.

As to a method of controlling power supply voltage, the predicted current consumption and the actually-measured current consumption according to the embodiment described above are modified into the predicted luminance and the actually-measured luminance. However, the power supply voltage is controlled correspondingly to a relationship between the predicted luminance and the actually-measured luminance as in the control of the power supply voltage corresponding to the relationship between the predicted current consumption and the actually-measured current consumption.

Luminance of light emitted from the organic EL panel 3 is measured with a luminance meter, for example, during a predetermined period (for example, for several seconds). For this reason, there is a tendency that an interval of timings when the power supply voltage is changed becomes longer than that of the embodiment described above.

Here, as shown in FIG. 10, description has been given by taking the adjustment system 700B in which the luminance obtaining portion 200 is provided separately from the image display device 1B as a specific example. However, the present invention is not limited thereto, and the structure may be made so that the luminance obtaining portion is contained in the image display device.

Figure 12:
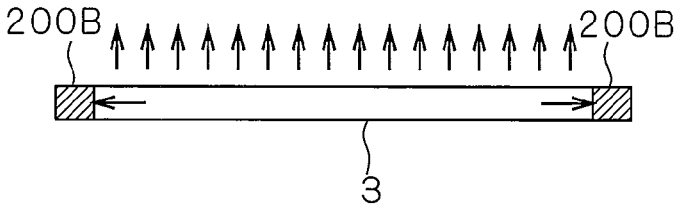
FIG. 12 is a diagram for describing the adjustment system according to Modification 3.

For example, as shown in FIG. 12, there is conceivable a mode in which the luminance obtaining portion 200B is arranged on lateral side of the organic EL panel 3, not on the front side thereof. Specifically, for example, the luminance obtaining portion 200B is configured so as to obtain luminance of light (lateral light) emitted toward a side of protective glass provided on the front side of the organic EL panel 3. Note that in FIG. 12, an upside thereof is the front side of the organic EL panel 3, and an arrow indicates an advancing direction of light emitted from the organic EL panel 3.

In this mode, however, it is difficult to measure luminance of light emitted from the entire screen of the organic EL panel 3 with the luminance obtaining portion 200B. Therefore, it is required to recognize predicted luminance corresponding to light to be measured and make comparison.

(Modification 4)

In the embodiment described above, the current value obtaining portion 4 is contained in the image display device 1, but the present invention is not limited thereto. There is conceivable a mode in which the current value obtaining portion is added to the image display device.

Figure 13:
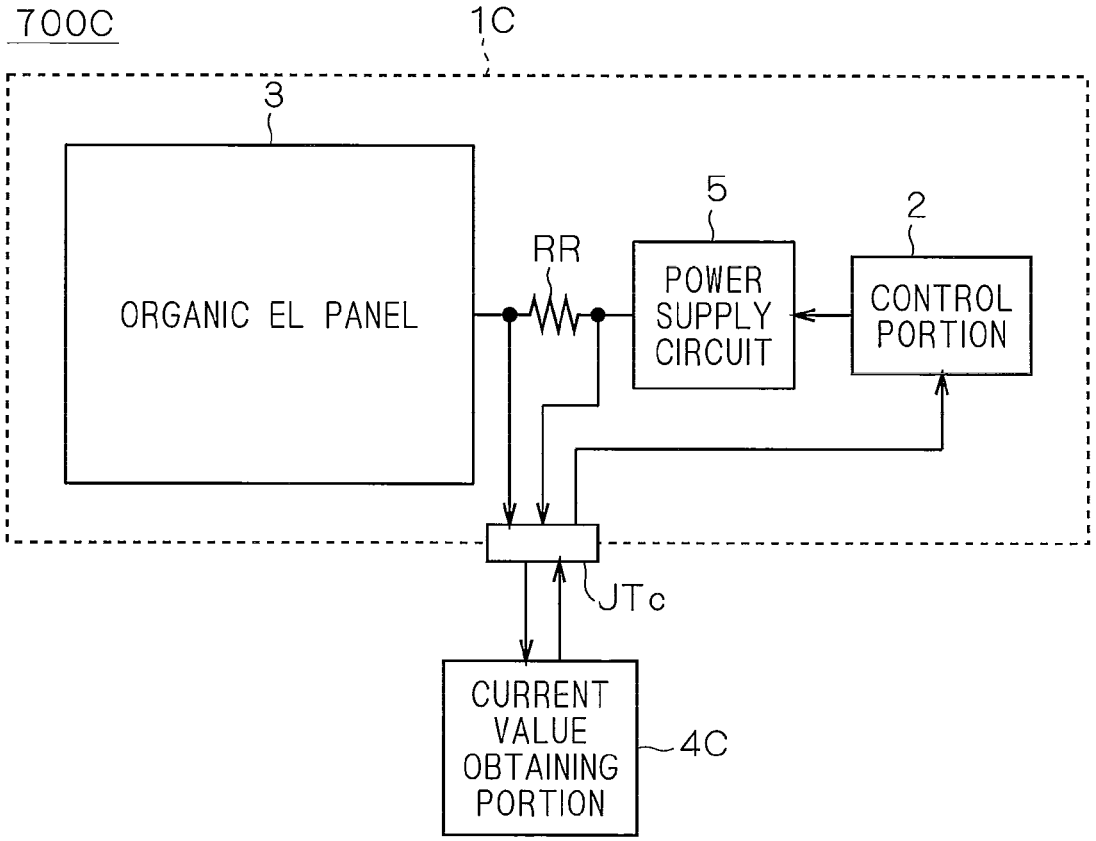
FIG. 13 is a diagram showing an outline of an adjustment system according to Modification 4.

FIG. 13 is a diagram showing an outline of an adjustment system 700C which adjusts an image display device 1C according to Modification 4.

The adjustment system 700C includes the image display device 1C and a current value obtaining portion 4C, and the current value obtaining portion 4C is configured separately from the image display device 1C.

The current value obtaining portion 4C obtains the actually-measured current consumption Ir of the organic EL panel 3. Here, the actually-measured current consumption Ir is obtained by actually measuring current (power supply current) which is supplied from the power supply circuit 5 and is consumed by the organic EL panel 3 while causing the respective light-emitting elements of the organic EL panel 3 to emit light correspondingly to image data.

This current value obtaining portion 4C is electrically connected to the image display device 1C via a cable and a connection portion JTc. For example, a terminal at an edge of the cable drawn from the current value obtaining portion 4C is electrically connected to a terminal provided in the image display device 1C, whereby the connection portion JTc is formed. For example, a resistor RR is provided in a circuit in which the power supply circuit 5 and the organic EL panel 3 are electrically connected to each other, and the current value obtaining portion 4C is electrically connected in parallel with the resistor RR.

Figure 14:
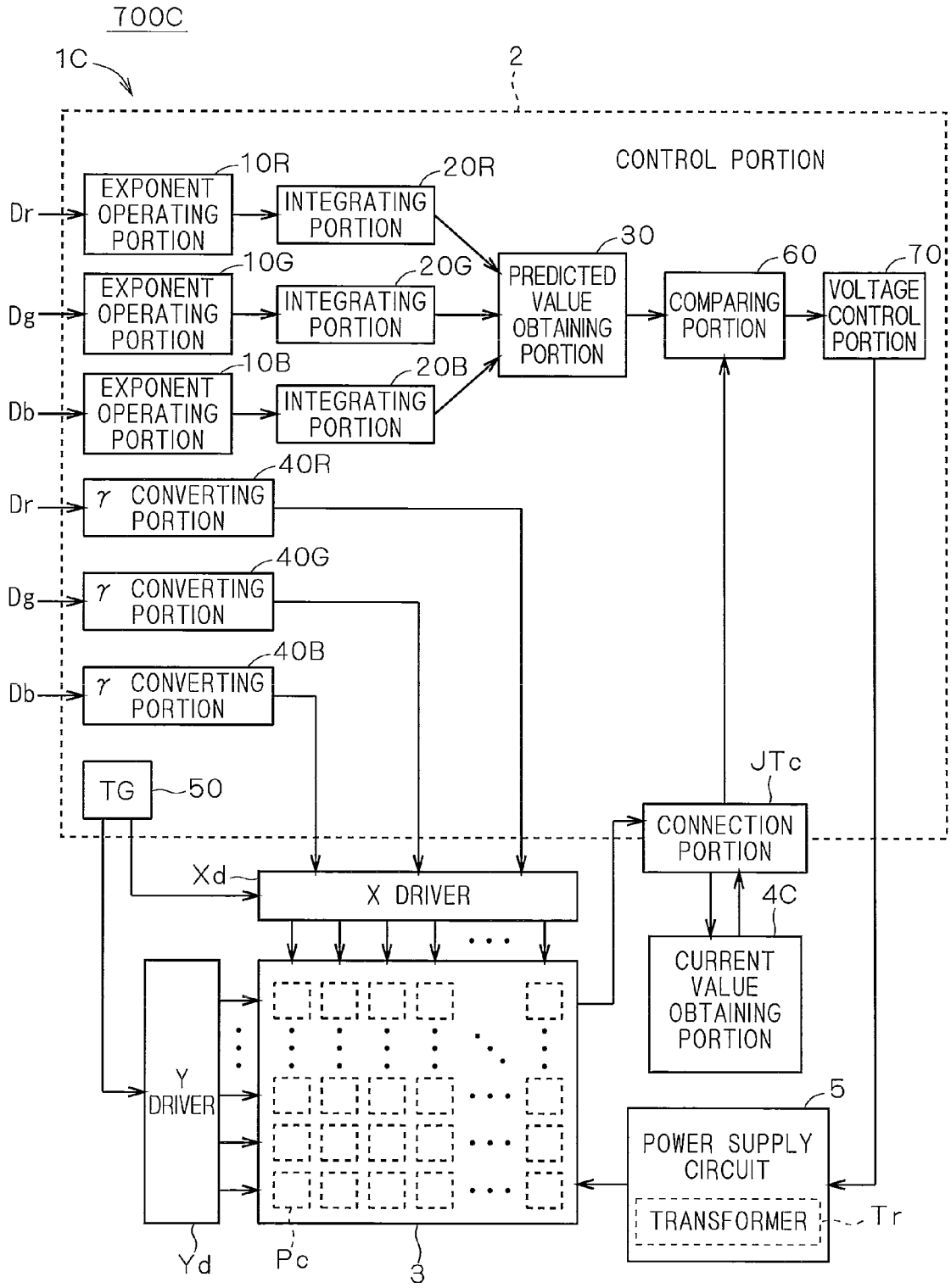
FIG. 14 is a block diagram showing a functional structure of the adjustment system according to Modification 4.

FIG. 14 is a block diagram showing a functional structure of the adjustment system 700C which adjusts the image display device 1C according to Modification 4.

As compared with the image display device 1 according to the embodiment described above, in the adjustment system 700C, the current value obtaining portion 4 of the image display device 1 according to the embodiment described above is provided outside the image display device. The current value obtaining portion 4 is configured so as to obtain the actually-measured current consumption Ir via the connection portion JTc and transmit information indicating the actually-measured current consumption Ir to the comparing portion 60. The other structure is similar to that of the embodiment described above. Note that like reference symbols are used to denote the structure similar to that of the embodiment described above, and description thereof will be omitted. In Modification 4, the recognizing portion is the exponent operating portions 10R, 10G and 10B, the integrating portions 20R, 20G and 20B and the predicted value obtaining portion 30. Further, it may be employed a mode in which an external circuit including a voltage control portion is added to the image display device.

(Modification 5)

In Modification 1 described above, the power supply voltage applied to both ends of the light-emitting elements included in the respective pixel circuits is adjusted for stabilizing light-emitting luminance with respect to a characteristic change over time or temperature change, but the present invention is not limited thereto. For example, power of the image data which is supplied to the respective pixel circuits of the organic EL panel 3 may be adjusted. Alternatively, voltage applied to both ends of the light-emitting element and voltage of image data signal may be both adjusted. In the latter case, voltage of an image data signal is caused to fluctuate by approximately 30 to 50% of a fluctuation amount of the power supply voltage applied to both ends of the organic EL element. Accordingly, the current consumption of the organic EL panel 3 can be changed not only using current-voltage characteristics (I-V characteristics) of the organic EL elements included in the respective pixel circuits Pc but also using current-voltage characteristics (I-V characteristics) of a TFT for controlling a flow of current into the organic EL elements in the respective pixel circuits Pc. When the structure as described above is adopted, it is possible to increase a width of change in luminance with respect to a change in power supply voltage of the organic EL panel 3. Note that the following description will be given with a specific example of a functional structure of an image display device in which such structure is adopted.

Figure 15:
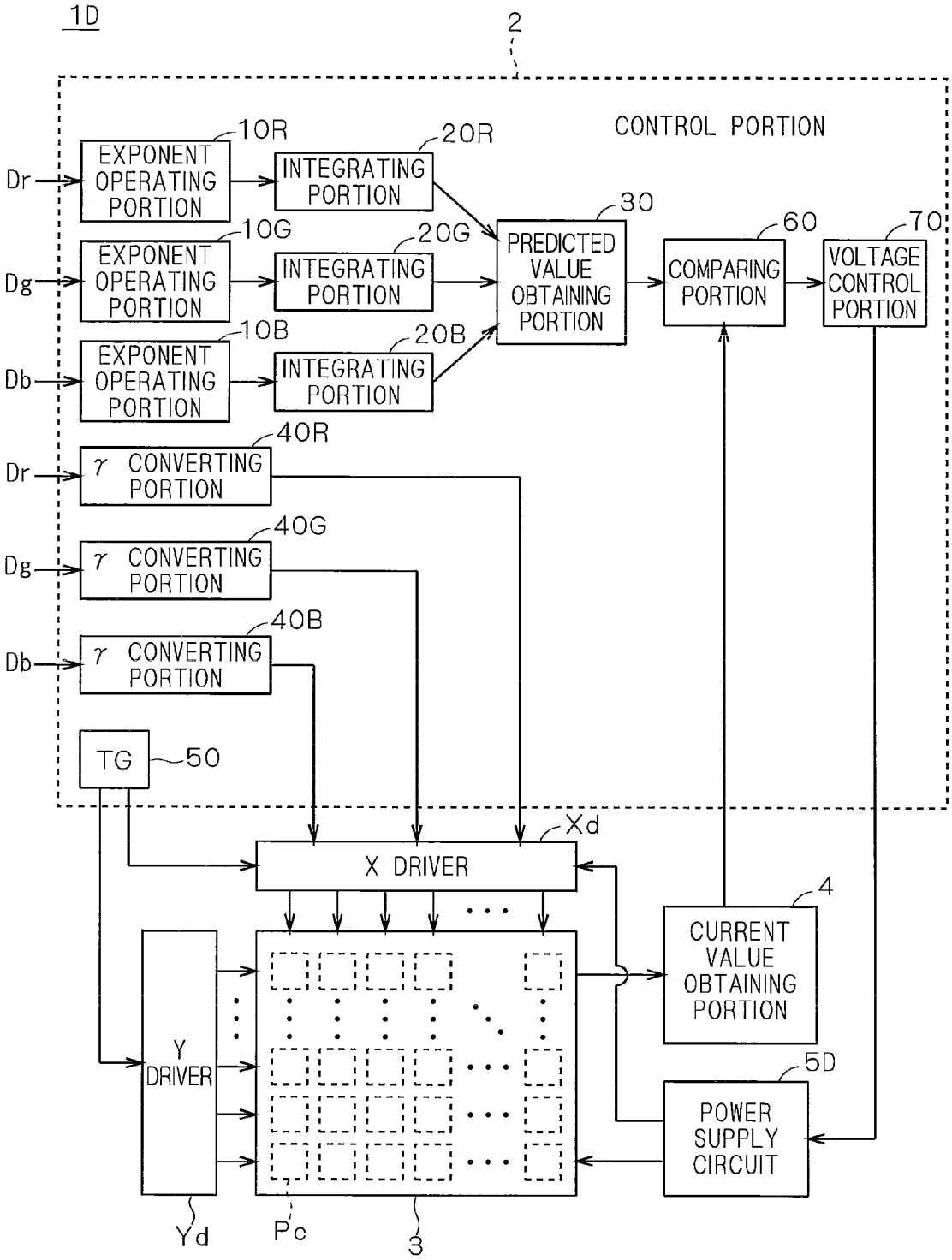
FIG. 15 is a block diagram showing a functional structure of an image display device according to Modification 5.

FIG. 15 is a block diagram showing a functional structure of an image display device 1D according to Modification 5. A power supply circuit 5D adjusts power supply voltage applied to the both ends of the light-emitting elements included in the respective pixel circuits in response to a signal from the voltage control portion 70, and also adjusts power supply voltage applied to the X driver Xd. When the voltage applied to the X driver Xd is adjusted, voltage of an image data signal supplied to the pixel circuit is changed.

(Modification 6)

In Modification 3 described above, luminance of light emitted from a plurality of light-emitting elements included in a plurality of pixel circuits Pc of the organic EL panel 3 is set as a parameter being a target of comparison, but the present invention is not limited thereto.

Illuminance and luminance (for example, illuminance/luminance) around the organic EL panel 3 may be set as a parameter. That is, the power supply voltage of the organic EL panel 3 may be controlled in accordance with a state in which the organic EL panel 3 is used, that is, brightness therearound. Specifically, in addition to the luminance meter with which luminance of light emitted from the organic EL panel 3 is measured in Modification 3 described above, there is provided an illuminance meter with which brightness around the organic EL panel 3 is measured.

Illuminance around the organic EL panel 3 when light is turned off is actually measured with the illuminance meter, and a value obtained by dividing the illuminance by a luminance value of the organic EL panel when light is emitted is set as an actually-measured value. In addition, a desired illuminance/luminance value is set as a predicted value in advance, and a first reference range and a second reference range are determined with the predicted value being as a reference.

In a case where the actually-measured value is larger than the predicted value, the power supply voltage of the organic EL panel 3 is made large. On the other hand, in a case where the actually-measured value is smaller than the predicted value, the power supply voltage of the organic EL panel 3 is made small.

With the structure as described above, the power supply voltage is increased/decreased in accordance with illuminance which is directly linked to how the screen is actually viewed, whereby it is possible to stabilize light-emitting luminance.

(Other Modifications)

In the embodiment described above, the description has been given assuming that the image data includes image signals of three colors, R, G and B, and the organic EL panel 3 emits light of three colors of R, G and B, but the present invention is not limited thereto. For example, the present invention is applicable to the structure in which the image data includes an image signal of given one color (more generally, one or more colors) and the organic EL panel 3 emits light of given one color (more generally, one or more colors).

In the embodiment and Modifications described above, the actually-measured value and the predicted value of the parameter (for example, such as current consumption or luminance) on driving of the plurality of pixel circuits Pc arranged in the entire screen of the organic EL panel 3 are obtained, and the power supply voltage is appropriately controlled in accordance with the comparison result between the actually-measured value and the predicted value. However, the present invention is not limited thereto.

For example, there is also conceivable a structure in which the entire screen of the organic EL panel 3 is divided into a plurality of areas, and the actually-measured value and the predicted value of a given parameter on driving of the plurality of pixel circuits Pc are obtained for each area, whereby the power supply voltage is appropriately controlled in accordance with the comparison result between the actually-measured value and the predicted value. Note that, as part of an area of the entire screen, there may be adopted diverse areas such as a so-called area for one line, which is composed of the plurality of pixel circuits Pc arranged in a predetermined direction, and an area having a plurality of lines.

In the embodiment described above, the parameter (for example, current consumption) on driving of the pixel circuit Pc is measured at a predetermined timing during the light-emitting period for each frame, but the present invention is not limited thereto. For example, the parameter may be measured at a predetermined timing during the light-emitting period for one frame among a given number of frames. That is, the current consumption may be measured at intervals of N-times (N is a natural number) the light-emitting period for one frame. Note that, with such structure, the power supply voltage is adjusted for each given number of frames.

The invention claimed is:

1. An image display device, comprising:

a pixel circuit including a light-emitting element;

a recognizing portion recognizing a predicted value of a parameter based on image data representing images to be displayed before the light-emitting element is driven by the image data, the parameter being generated in accordance with driving of the pixel circuit and including a current required for driving the pixel circuit and for the light-emitting element included in the pixel circuit emitting light;

an obtaining portion obtaining an actually-measured value of the parameter associated with causing the light-emitting element to emit light in accordance with the image data, the actually-measured value of the parameter including a current consumed to drive the pixel circuit;

a power supply portion applying a power supply voltage to the pixel circuit;

a comparing portion comparing the predicted value calculated based on the image data and the actually-measured value including the current consumed to drive the pixel circuit with each other to determine if the actually-measured value falls outside a reference range that includes the predicted value with a certain margin; and a control portion supplying a control signal to the power supply portion in accordance with a comparison result of the comparing portion, wherein the control portion is configured to supply the control signal to increase/decrease the power supply voltage, without changing the image data, in response to determining that the actually-measured value including the current consumed to drive the pixel circuit falls outside the reference range so that the actually-measured value including the current consumed to drive the pixel circuit is in the reference range and to stop the increase/decrease of the power supply voltage in response to determining that the actually-measured value including the current consumed to drive the pixel circuit is in the reference range.

2. The image display device according to claim 1, wherein the power supply voltage is decreased in a case where the actually-measured value is higher than the predicted value, and the power supply voltage is increased in a case where the actually-measured value is lower than the predicted value.

3. The image display device according to claim 1, wherein the power supply voltage applied to the pixel circuit includes at least any one of a voltage applied to both ends of the light-emitting element and a voltage of the image data.

4. The image display device according to claim 1, wherein the increase/decrease of the power supply voltage is stopped when the actually-measured value reaches the predicted value.

5. The image display device according to claim 1, wherein the actually-measured value and the predicted value are each values of the parameter, the parameter being on driving of a plurality of the pixel circuits arranged in an entire screen.

6. The image display device according to claim 1, wherein the actually-measured value is a value measured at a predetermined timing during a light-emitting period for one frame in which the light-emitting element emits light.

7. The image display device according to claim 1, further comprising:

an image signal line supplying a data signal to the pixel circuit; and an image signal line driving circuit controlling a timing at which the data signal is supplied to the image signal line, wherein the control portion increases/decreases the power supply voltage applied to the image signal line driving circuit in accordance with a change of the power supply voltage.

8. The image display device according to claim 1, wherein the power supply portion is configured to supply the increased/decreased power supply voltage to the pixel circuit according to the control signal without changing the image data.

9. A control method for an image display device including a pixel circuit including a light-emitting element, comprising:

recognizing a predicted value of a parameter based on image data before the light-emitting element is driven by the image data, the parameter being generated in accordance with driving of the pixel circuit and including a current required for driving the pixel circuit and for the light-emitting element included in the pixel circuit emitting light, and the predicted value being calculated based on the image data;

supplying a power supply voltage for driving the pixel circuit from a power supplying portion;

obtaining an actually-measured value of the parameter associated with causing the light-emitting element to emit light in accordance with the image data, the actually-measured value being measured in the pixel circuit driven by the image data and including a current consumed to drive the pixel circuit;

determining if the actually-measured value including the current consumed to drive the pixel circuit falls outside a reference range that includes the predicted value with a certain margin;

supplying a control signal to the power supply portion to increase/decrease the power supply voltage applied to the pixel circuit without changing the image data so that the actually-measured value including the current consumed to drive the pixel circuit is in the reference range, in response to determining that the actually-measured value including the current consumed to drive the pixel circuit falls outside the reference range; and stopping the increase/decrease of the power supply voltage in response to determining that the actually-measured value including the current consumed to drive the pixel circuit is in the reference range.

10. The control method according to claim 9, wherein the increased/decreased power supply voltage is supplied from the power supply portion to the pixel circuit according to the control signal without changing the image data.

11. An adjustment system for an image display device including a pixel circuit including a light-emitting element, comprising:

an image display device; and an external circuit connected to the image display device, wherein:

the image display device includes:

a recognizing portion recognizing a predicted value of a parameter based on image data before the light-emitting element is driven by the image data, the parameter being generated in accordance with driving of the pixel circuit and including a current required for driving the pixel circuit and for the light-emitting element included in the pixel circuit emitting light;

a power supply portion applying a power supply voltage to the pixel circuit;

an obtaining portion measuring a value of the parameter associated with causing the light-emitting element to emit light in accordance with the image data, to thereby obtain an actually-measured value of the parameter including a current consumed to drive the pixel circuit; and a comparing portion comparing the predicted value calculated based on the image data and the actually-measured value including the current consumed to drive the pixel circuit with each other to determine if the actually-measured value including the current consumed to drive the pixel circuit falls outside a reference range that includes the predicted value with a certain margin;

the external circuit includes a control portion supplying a control signal to the power supply portion to control the power supply voltage applied to the pixel circuit in accordance with a comparison result of the comparing portion; and the control portion is configured to supply the control signal to increase/decrease, in response to determining that the actually-measured value including the current consumed to drive the pixel circuit falls outside the reference range, the power supply voltage so that the actually-measured value falls within the reference range and to stop the increase/decrease of the power supply voltage in response to determining that the actually-measured value including the current consumed to drive the pixel circuit is in the reference range.

12. The adjustment system according to claim 11, wherein the power supply portion is configured to supply the increased/decreased power supply voltage to the pixel circuit according to the control signal without changing the image data.

* * * * *